US008885042B2

(12) United States Patent
Kim

(10) Patent No.: US 8,885,042 B2
(45) Date of Patent: Nov. 11, 2014

(54) SYSTEM AND METHOD FOR MEASURING FLIGHT PARAMETERS OF A SPHERICAL OBJECT

(76) Inventor: Jeong Yul Kim, Gwangju Si (KR)

( * ) Notice: Subject to any disclaimer, the term of this patent is extended or adjusted under 35 U.S.C. 154(b) by 605 days.

(21) Appl. No.: 13/201,429

(22) PCT Filed: Feb. 3, 2010

(86) PCT No.: PCT/KR2010/000663

§ 371 (c)(1),
(2), (4) Date: Aug. 12, 2011

(87) PCT Pub. No.: WO2010/093141

PCT Pub. Date: Aug. 19, 2010

(65) Prior Publication Data

US 2011/0292203 A1 Dec. 1, 2011

(30) Foreign Application Priority Data

Feb. 12, 2009 (KR) ..... 10-2009-0011450

(51) Int. Cl.
*H04N 7/18* (2006.01)
*A63B 24/00* (2006.01)
*A63B 69/36* (2006.01)

(52) U.S. Cl.
CPC ..... *A63B 69/3658* (2013.01); *A63B 2243/0083* (2013.01); *A63B 24/0021* (2013.01); *A63B 2220/35* (2013.01); *A63B 2243/0025* (2013.01); *A63B 2243/0029* (2013.01); *A63B 2243/0004* (2013.01); *A63B 2220/30* (2013.01); *A63B 2024/0034* (2013.01); *A63B 2024/0031* (2013.01)
USPC ..... 348/135; 348/E7.085

(58) Field of Classification Search
USPC ..... 348/135
See application file for complete search history.

(56) References Cited

U.S. PATENT DOCUMENTS 6,579,190 B2 6/2003 Yamamoto

FOREIGN PATENT DOCUMENTS

| | | | |
|---|---|---|---|
| KR | 10-0871595 | * 11/2008 | ..... A63B 69/36 |
| KR | 10-2008-0106904 | 12/2008 | |
| KR | 10-0871595 | 12/2008 | |

OTHER PUBLICATIONS

International Search Report for PCT/KR2010/000663 mailed Sep. 7, 2010.

* cited by examiner

*Primary Examiner* — Andy Rao
*Assistant Examiner* — Nguyen Truong
(74) *Attorney, Agent, or Firm* — Revolution IP, PLLC

(57) ABSTRACT

A system and a method for measuring flight parameters of a spherical object are disclosed. A trigger signal-generating unit generates and outputs a first trigger signal upon detection of a spherical object, and generates and outputs a second trigger signal when a reference time interval which is set on the basis of the maximum flight speed and the maximum rotating speed of the spherical object has elapsed from the point in time when the first trigger signal was generated. A photographing unit photographs images in a first image acquiring region having a predetermined region in which the spherical object exists, in accordance with the first trigger signal and the second trigger signal. An image-acquiring unit provides the photographing unit with the first trigger signal and the second trigger signal inputted by the trigger signal generating unit, and converts a plurality of images inputted by the photographing unit in accordance with the first and second trigger signals into digital images, and stores the digital images. A parameter-measuring unit calculates flight parameters including the flight speed, flight angle, rotating speed, and rotational axis of the spherical object from the plurality of digital images.

25 Claims, 17 Drawing Sheets

First image Second image

Third image Fourth image

SYSTEM AND METHOD FOR MEASURING FLIGHT PARAMETERS OF A SPHERICAL OBJECT

RELATED APPLICATIONS

This application is a 371 application of International Application No. PCT/KR2010/000663, filed Feb. 3, 2010, which in turn claims priority from Korean Patent Application No. 10-2009-0011450, filed Feb. 12, 2009, each of which is incorporated herein by reference in its entirety.

TECHNICAL FIELD

The present invention relates to a system and method for measuring flight parameters of a spherical object, and in particular to a system and method for measuring fight parameters of a spherical object which make it possible to measure flight parameters including a flight speed, a flight way and a rotation information of a spherical object flight over a space.

BACKGROUND ART

A flight way of a spherical object like a golf ball, a baseball ball, etc is determined at a moment that physical force is applied to a ball (namely, impact timing by a golf club or a bat). The information used for determining a flight way of a spherical object is formed of a rotation information of a ball (in other words, a rotation speed and a rotation axis), a flight direction, a speed, etc. There is a golf simulation system which is designed to estimate a flight trajectory of a flight spherical object. Most of the golf simulation systems are directed to generating a lattice shaped sensing region in a space through which a trajectory of a golf ball passes, by using a laser, a photodiode, an ultrasonic sensor, etc., whereby to measure a flight direction and speed of a golf ball with the aid of the information such as the position of a shadow of a golf ball or a golf ball measured at a moment that a golf ball passes through a sensing region, and the size of a golf ball. The above conventional golf simulation system is not capable of measuring a rotation information of a golf ball, so a method for estimating a rotation information of a ball by using a motion data (angle, trajectory, etc. of a golf club head) of a golf club is used instead. In this case, there is a limit in measuring the trajectory of an accurate impact of a golf ball. In addition, the conventional golf simulation uses a trigger device generating a light screen by using a photodiode or a laser in order to judge whether or not a ball passes through a certain point for capturing a motion of a ball which flies at a high speed. When a trigger device is used, the trigger device is provided close to a flight way of a golf ball and a golf club at the time of impact, so interferences between a rigger device, a golf ball and a golf club occur.

The US patent publication number 2007-0213139 discloses a system (hereinafter referred to prior art 1) for measuring a trajectory of a golf club and flight parameter of a golf ball with a mark line with the aid of one high speed camera by using two sensor rows. The above system, however, is same a currently commercial screen golf system: The prior art 1 cannot accurately measure the rotation information of a golf ball, and it adapts an expensive high speed camera, thus increasing the whole manufacture cost of the system. Since a sensor is installed at a floor of a player's standing portion or at a certain height from the floor, a player might have psychological burden because a golf game originally gives a player a lot of stress, and a lot of errors occurs due to the malfunction of a sensor.

The Korean patent registration number 10-0871595 discloses a construction (hereinafter referred to prior art 2) which is directed to obtaining a flight information of a golf ball by providing a trigger signal by which initial speed is obtained by picturing the image of a golf ball with at least two mark lines (a circle formed on the surface of a golf ball about a central point of a golf ball in a form of a meridian) by using a high speed line scan camera, and a golf ball is pictured at a regular displacement interval based on two high speed cameras installed at left and right sides of a high speed line scan camera based on the objected initial speed. The above prior art 2 adapts a high speed line scan camera for detecting a golf ball and computing an initial speed, and a high speed camera is adapted to measure a flight parameter of a golf ball, so the entire manufacture cost increases. The prior art 2 does not consider the rotation characteristics of a golf ball. The trigger signal provided for a continuous picturing based on two high speed cameras serves to set about the displacement of a golf ball (in other words, the interval of trigger signals is set so that the golf balls of multiple images taken based on each trigger signal are not overlapped). According to the prior art 2, as shown in FIG. 1, it is impossible to precisely recognize whether or not the golf ball has rotated 30° in clockwise direction or has rotated 30° in counterclockwise direction based on the first taken image and the second taken image.

The US patent publication number 2007-0060410 discloses a system (hereinafter referred to prior art 3) for measuring a flight parameter of a golf ball based on two images taken by continuously picturing a golf ball with dots formed at each apex of a pentagonal shape and center of the same by using one high speed camera or two images taken by continuously picturing with two high speed cameras. The above prior art 3 does not consider the rotation characteristics of a golf ball. A trigger signal serves to set based on the displacement of a golf ball, which signal is provide for a continuous picturing based on one or two high speed cameras (in other words, the interval of trigger signals is set so that the golf balls of multiple images taken based on each trigger signal are not overlapped.) The prior art 3 has a problem that it is impossible to accurately measure whether or not a golf ball has rotates in clockwise direction or in counterclockwise direction, from the first taken image and the second take image.

DISCLOSURE OF INVENTION

Accordingly, it is an object of the present invention to provide an inexpensive system and method for measuring flight parameters which make it possible to accurately measure flight parameters including a rotation information of a spherical object unless a certain device is installed at the floor of a swinging region in order to measure the flight parameters of a spherical object.

It is another object of the present invention to provide a recording medium which is readable by a computer which has a program for executing a flight parameter measuring method on the computer, which flight parameter measuring method is directed to accurately measure flight parameters including a rotation information of a spherical object by using an inexpensive system unless a device for measuring flight parameters of a spherical object on the floor of a swinging region.

To achieve the above objects, there is provided a system for measuring flight parameters of a spherical object, comprising a trigger signal generation unit which generates and outputs a first trigger signal when a spherical object is detected, and generates and outputs a second rigger signal when a reference time interval set based on the maximum flight speed and the maximum rotation speed of the spherical object has passed since the generation time of the first trigger signal; a photographing unit which photographs a plurality of images of the spherical object with respect to a first image acquisition region having a certain area in accordance with a first trigger signal and a second trigger signal; an image acquisition unit which provides the first trigger signal and the second trigger signal, which are inputted from the trigger signal generation unit, to the photographing unit and converts and stores the plurality of the images inputted from the photographing unit into a digital image in response to the first trigger signal and the second trigger signal; and an information measuring unit which computes the flight parameter including a flight speed, a flight angle, a rotation speed and a rotation axis of a spherical object from the plurality of the digital images.

To achieve the above objects, there is provided a method for measuring flight parameters of a spherical object, comprising a step (a) for generating and outputting a first trigger signal when a spherical object is detected; a step (b) for photographing, multiple times, a first image of the spherical object in accordance with a first trigger signal with respect to a first image acquisition region having a certain area; a step (c) for generating ad outputting a second trigger signal when a reference time interval set based on the maximum flight speed and the maximum rotation speed of the spherical object is passed since the generation timing of the first trigger signal; a step (d) for photographing, multiple times, a second image of the spherical object with respect to the first image acquisition region in accordance with a second trigger signal; and a step (e) for computing the flight parameter including a flight speed, a light angle, a rotation angle and a rotation axis of the spherical object from the first and second images.

Advantageous Effects

According to the system and method for measuring flight parameters of a spherical object according to the present invention, it is possible to accurately measure flight parameters including a rotation information of a spherical object with the aid of an inexpensive system unless a device for measuring flight parameters is installed at the floor of a swinging region. The entire manufacture cost of the system can be reduced by implementing the functions of two high speed line scan cameras by using only one inexpensive area camera in such a way to increase the processing speed of an A/D converter of an area camera by activating part of CCD lines among the CCD lines belonging to an image sensor of a conventional area camera. In addition, it is possible to accurately measure a rotation information of a spherical object by using a spherical object with a specific pattern thereon, and a time interval of twice trigger signals is set based on the maximum flight sped and the maximum rotation speed of a spherical object, whereby to accurately measure flight parameters and rotation information of a spherical object.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

The system and method for measuring flight parameters of a spherical object according to a preferred embodiment of the present invention will be described in details with reference to the accompanying drawings. In the following descriptions, the scope of the invention is not limited to the disclosed contents, and the present invention might be applied to diverse spherical objects like a baseball ball or the like.

Figure 1:
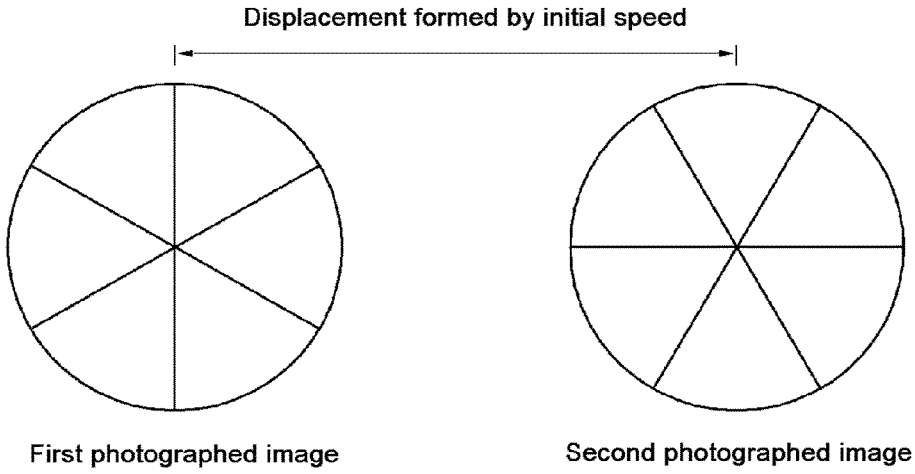
FIG. 1 is a view of an image obtained by picturing, with a time difference, a golf ball with a marking pattern in a conventional system for measuring flight parameters of a spherical object.
Figure 2:
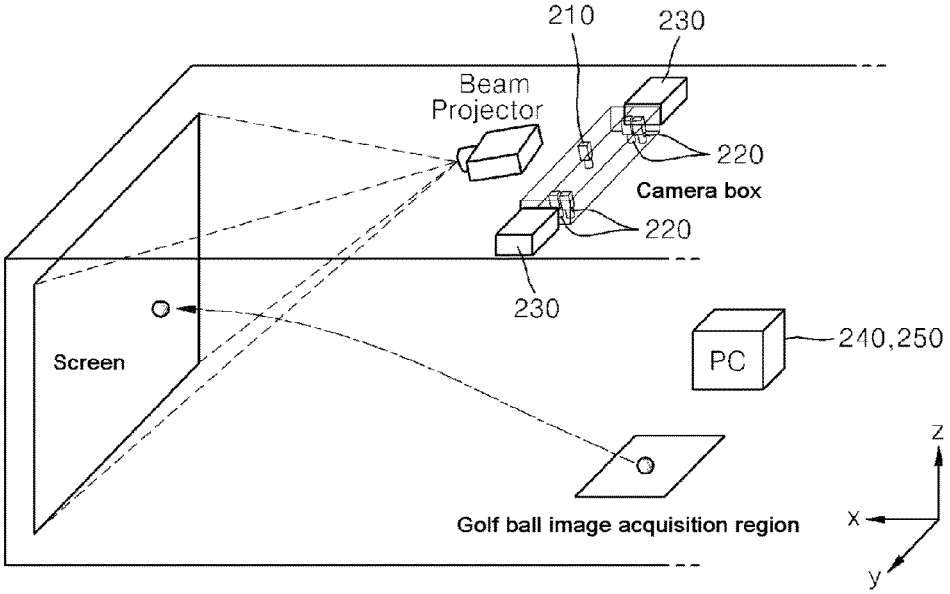
FIG. 2 is a view illustrating the construction of a system for measuring flight parameters of a spherical object according to a preferred embodiment of the present invention.
Figure 3:
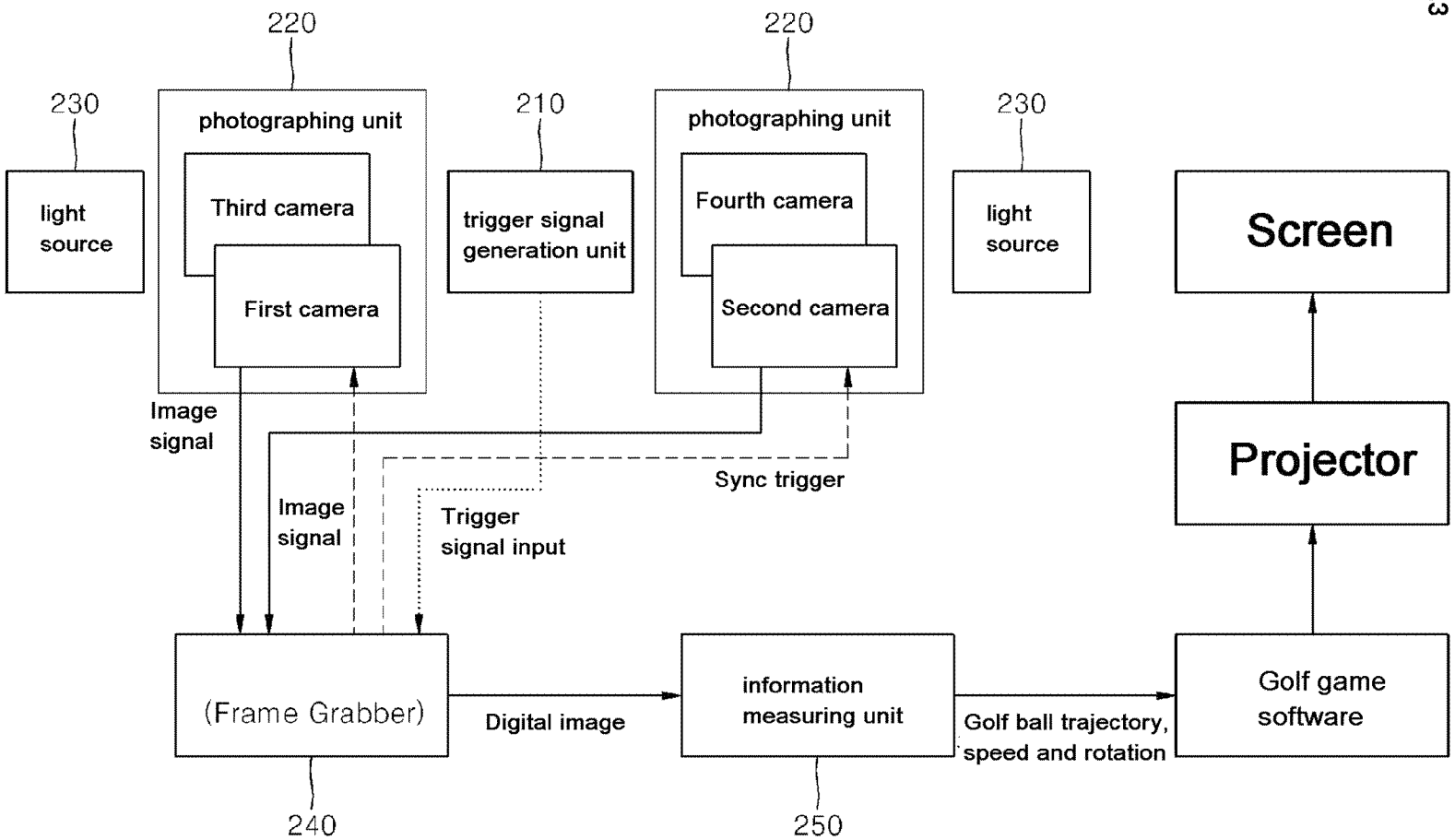
FIG. 3 is a block diagram of a construction of a system for measuring flight parameters of a spherical object according to a preferred embodiment of the present invention.

FIG. 2 is a view illustrating the construction of a system for measuring flight parameters of a spherical object according to a preferred embodiment of the present invention, and FIG. 3 is a block diagram of a construction of a system for measuring flight parameters of a spherical object according to a preferred embodiment of the present invention.

As shown in FIGS. 2 and 3, the system for measuring flight parameters of a spherical object according to the present invention comprises a trigger signal generation unit 210, a photographing unit 220, a lighting unit 230, an image acquisition unit 240, and an information measuring unit 250.

The trigger signal generation unit 210 is installed at an upper side of a swinging region where a golf ball is placed (preferably, on a ceiling of a swinging space) for generating trigger signals when a golf ball passes through the image acquisition region. Here, the trigger signal generation unit 210 is preferably moved slightly to the side of a screen in order to prevent any interference by a golfer. The trigger signal generated by the trigger signal generation unit 210 is transmitted to the image acquisition unit 240. The trigger signal generation unit 210 is formed of an area camera formed of line sensors formed in multiple rows, and the photographing region of the area camera is preferably matched with the photographing regions of four area cameras. In the present invention, it is needed to change the area camera adapted to the trigger signal generation unit 210 in order to the same effects as the high speed line sensor camera at a lower cost. Only part of the image sensor provided at the area camera (in other words, part CCD lines among the N numbers of CCD lines) is activated, so the number of the frames per second can be increased.

Figure 4:
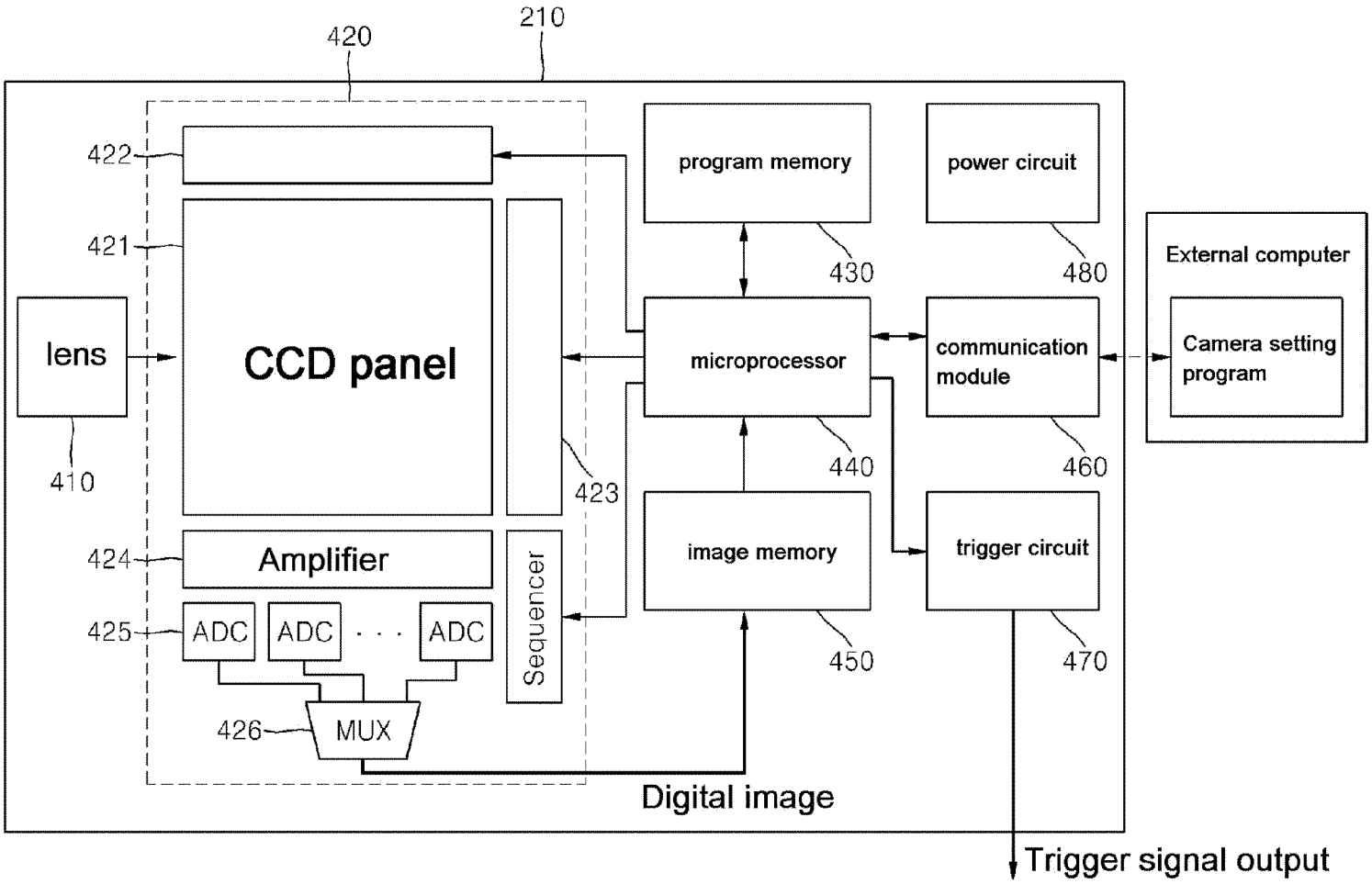
FIG. 4 is a view of a structure of a camera adapted to a trigger signal generation unit.

FIG. 4 is a view of a derailed structure of a camera adapted to a trigger signal generation unit 210. As shown in FIG. 4, the trigger signal generation unit 210 comprises a lens 410, an image sensor 420, a program memory 430, a microprocessor 440, an image memory 450, a communication module 460, a trigger circuit 470 and a power circuit 480.

The image sensor 420 serves to convert the light made incident via the lens 410 into electrical signals. The image sensor 420 comprises a CCD panel 421 in which charge coupled devices are arranged in an array shape, a horizontal direction address register 422, a vertical direction address resister 423, an amplifier 424, a plurality of A/D converters 425 and a multiplexer 426.

The image sensor 420 has the same construction as the image sensor adapted to a conventional area camera. The image sensor with a conventional area camera serves to convert the analog signal from all CCD lines via the A/D converter into a digital image signal. During the signal conversions, a lot of processing time is needed. Since it is impossible to photograph a plurality of images within short time to an extent that the rotation information of the golf ball can be measured by a conventional area camera, most of the flight parameter measuring system is equipped with expensive high speed line scan cameras. In order to overcome the above problems, the present invention proposes increasing the processing speed of the A/D converter 425 by activating part of CCD lines among a plurality of CCD lines belonging to the CCD panel 421 of the image sensor 420. In case of the image sensor which photographs 250 images per second with respect to the full frames of 640×480 pixels, it is possible to photograph more than 3000 images per second with the aid of the increase of the processing speed of the A/D converter by activating five CCD lines among the whole number of CCD lines. The scan cycle of the image sensor 420 in which only five CCD lines are activated is 3 kHz, and when the processing speed of the microprocessor 440 is increased, it is possible to obtain higher scan cycles (in other words, more images per second can be photographed).

The region for converting the analog signals into the digital signals using the A/D converter 425 with respect to the photographing images by changing the setting of the program memory 430 is adjusted for activating only the part of the CCD lines, which operation can be made possible with the aid of a random windowing of an area camera adapted to the trigger signal generation unit 310. In other words, it is possible to set so that only the part of the CCD lines of the entire CCD panel 421 can be changed to the digital images with the aid of the random windowing function that the image sensor 420 supports. So, the same functions as using a plurality of expensive high speed scan trigger cameras can be obtained by using a single inexpensive area camera. Here, the microprocessor 540 judges whether or not the golf ball has passed only based on the image data photographed by the CCD lines with the size and flight characteristics of the golf ball. The images from the activate CCD lines are converted into the digital signals via the A/D converter 425 and then are temporarily stored in the image memory 450.

The program memory 430 stores the firm wares for the operations of the hardware of the camera and the program for generating trigger signals after the pass of the golf ball is judged by analyzing the digital images stored in the image memory 450, which digital images are photographed by the image sensor 420. The microprocessor 440 executes the program stored in the program memory 430 and judges whether or not the golf ball has passed, and generates the trigger signals and performs the functions that the changes (in other words, changes of photographing region) of the active CCD line of the image sensor 420 transferred from the outside of the camera via communication are adapted to the image sensor 420.

The communication module 460 communicates data between the trigger signal generation unit 210 and the external computer and might be formed of a wired communication module like USB communication module or a wireless communication module like a Bluetooth communication module. Here, the data communication via the communication module 460 is allowed only when setting the trigger signal generation unit 210, and the data communication via the communication module 460 is preferably limited for the real time operation when in the actual operation. When the communication module 461 is formed of a USB communication module, the images photographed by the trigger signal generation unit 210 via the USB port are transmitted to the camera setting program installed in an external computer, and the image photographing region designated by the camera setting program and the parameters related to the recognition of the golf ball are transmitted to the trigger signal generation unit 210. The camera setting program is equipped with a function for changing the region where the pass of the golf ball is detected in the whole photographing region of the trigger signal generation unit 210 and a function for changing the setting values of the image analysis logic which analyzes the pass of the golf ball operating in the trigger signal generation unit 210. Here, the trigger signal generation unit 210 operates independently from the camera setting program executed in the external computer, and the camera setting program is preferably used only when setting the trigger signal setting program. The trigger circuit 470 outputs a trigger signal of the TTL level to the image acquisition unit 240 at the time when a control command is inputted from the micro processor 440. In addition, the power circuit 480 performs a power management function needed for the operations of the internal electronic circuits of the camera.

The method of setting the camera adapted to the trigger signal generation unit 210 of FIG. 4 and the method of generating trigger signals by using the same will be described.

In the present invention, the camera adapted to the trigger signal generation unit 210 is formed of a conventional area camera. It is needed to selectively activate only the sensor lines which is part of the entire sensor lines or the use as a high speed trigger camera. A user or a manager provides information concerning the lines to be activated among the CCD lines of the image sensor 410 to the microprocessor 440 via an external computer connected with the trigger signal generation unit 210 via the communication module 460. The microprocessor 440 serves to activate only the CCD lines designated by the user or the manager among the whole CCD lines by using the random windowing function that the image sensor 410 supports. At this time, at least one CCD line (hereinafter referred to "active CCD line") among the CD lines of the image sensor 310 arranged in the direction that the golf ball flies is designated.

Figure 5:
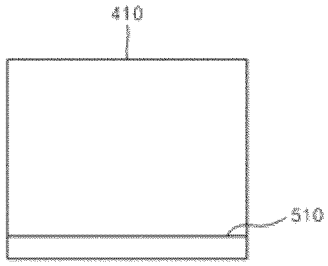
FIG. 5 is a view of an example that one CCD line is designated as an active CCD line among the CCD lines belonging to an image sensor adapted to a trigger signal generation unit.

FIG. 5 is a view of an example that one CCD line is designated as an active CCD line. As shown therein, when a golf ball is position at an active CCD line 510, an image with a certain with having a higher brightness as compared to a background lawn color is photographed in the direction of line. So, the analog image signal photographed by the active CCD line 510 is converted into a digital image signal by the A/D converter 425. The microprocessor 440 judges whether or not the golf ball has passed based on the width of the region where the brightness level of the digital image signal higher than a previously set threshold value continues. The white color golf ball has a high reflectivity value of light as compared to a certain obstacle such as a golf club or a player's body, so it is possible to detect the golf ball based on the brightness level of the digital image signal. The microprocessor 440 judges as a golf ball when the width of the region in which the value higher than the previously set threshold value corresponding to the brightness level of the digital image signal continues, exists in the range of the detection width of the gold ball (in other words, a range between the upper limit value and the lower limit value set about the diameter of the gold ball). When one CCD line is designated as the active CCD line 510, and when the photographing cycle of the image sensor 410 is 3000 times per second, and the maximum speed of the golf ball that the golfer has impacted is about 84 m/s, the golf ball with the diameter of about 4.2 cm is photographed at least one time by the active CCD line 510.

Figure 6:
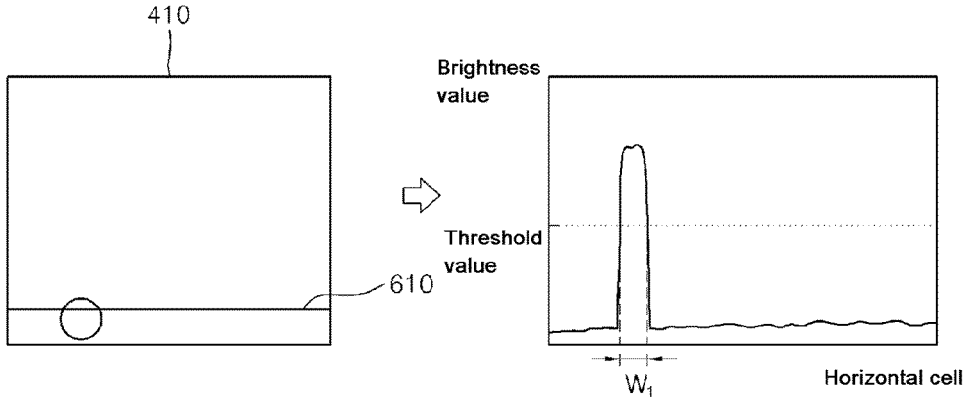
FIGS. 6 and 7 are views of the digital image signals of a golf ball positioned at one active CCD line and a golf ball positioned at a corresponding position.
Figure 7:
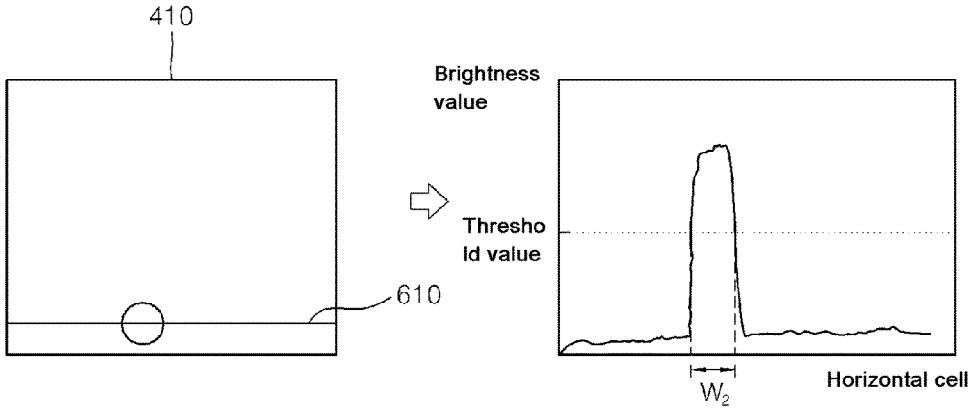

FIGS. 6 and 7 are views of a digital image signal photographed by each golf ball positioned on the active CCD line 610. As shown in FIGS. 6 and 7, in case of the digital image signal, the digital image signal inputted into the microprocessor 440 is characterized in that the brightness of the portion corresponding to the size of the golf ball positioned at the active CCD line 610 when the active CCD line 610 photographs the image is higher than the threshold value (value set between the brightness level of artificial lawn and the brightness level of the golf ball). So, When the golf ball passes through the active CCD line 610, the microprocessor 440 detects the widths $W_1$ and $W_2$ of the region having a brightness level higher than a previously set threshold value and the next digital signals which are inputted, whereby to judge whether or not the golf ball passes through, based on the width of a corresponding region and the diameter of the golf ball. At this time, the position of the active CCD line, the brightness threshold value and the upper and lower limit values of the judging width of the golf ball can be changed in the camera setting program which is executed in the external computer.

As shown in FIGS. 6 and 7, the width of the region having a brightness level higher than the threshold value based on the position of the golf ball becomes larger when the center of the golf ball is positioned at the active CD line 610 (in other words, $W_2$ of FIG. 7) rather than when only the part of the golf ball is positioned at the active CCD line 610 (in other words, $W_1$ of FIG. 6). If it is judged that the golf ball has passed, the microprocessor 440 instruct the trigger circuit 470 to generate a trigger signal, and then the trigger circuit 470 generates trigger signals and outputs to the image acquisition unit 240.

At this time, the image acquisition unit 240 should be given trigger signals in series two times in order to measure the speed information and direction information of the golf ball. In addition, in order to accurately measure the rotation information of the golf ball, the time interval is preferably adjusted between two trigger signals transmitted to the image acquisition unit 240. In other words, it is possible to accurately recognize the rotation direction of the golf ball only when the rotation is less than 180° irrespective of the change of the rotation axis. In the present invention, the time interval between two trigger signals is determined depending on the maximum flight speed and the maximum rotation speed of the golf ball that the golfer has impacted.

When it is considered that the golf ball flies at the maximum flight speed, the time interval between the first and second trigger signals should be set so that the photographing unit 220 photographs the golf ball by means of the second trigger signal before the golf ball passes through the photographing unit 220 from the time that the photographing unit 220 has photographed the golf ball based on the first trigger signal. The maximum value $dT_{max1}$ [S] is, therefore, of the time interval of the trigger signal based on the maximum flight speed of the golf ball can be expressed as follows.

The $$dT_{max1} = \frac{(L_v - D_v)}{V_{max}} \qquad \text{formula 1}$$

where $L_v$ represents the length of the vertical direction (flight direction of the golf ball) of the photographing region of the photographing unit 220, and $D_v$ represents the distance that the golf ball has flew in the vertical direction of the photographing region until the golf ball is photographed from the coming-in boundary of the photographing region of the photographing unit 220 in accordance with the first trigger signal (the distance is actually same as the distance up to the going-out boundary of the photographing region of the active CCD line of the trigger signal generation unit 210 from the coming-in boundary of the photographing region of the photographing unit 220), and $V_{max}$ represents the maximum flight speed of the golf ball.

When it is considered that the golf ball rotates at the maximum rotation speed, only when the angle that the golf ball has rotated between the image photographing timing in accordance with the first trigger signal and the image photographing timing in accordance with the second trigger signal is less than 180°, the rotation direction and the rotation angle of the golf ball can be accurately computed. If the rotation angle of the golf ball between two timings is more than 180°, since two solutions from the mathematical formula exist with respect to the rotation direction and the rotation angle, it is impossible to judge the accurate rotation of the golf ball. The maximum value $dT_{max2}$ [S] of the time interval of the trigger signal based on the maximum rotation speed of the golf ball can be expressed as follows.

$$dT_{max2} = \frac{30}{N_{max}} \quad \text{Formula 2}$$

where $N_{max}$ represents the maximum rotation speed of the golf ball.

The maximum value $dT_{max}$ of the time interval between two trigger signals becomes small one between $dT_{max1}$ and $dT_{max2}$, consequently, the time interval between two trigger signals is determined by the following formula.

$$dT_{max}=\min(dT_{max1}, dT_{max2}) \quad \text{Formula 3}$$

When the position of the golf ball when photographing the golf ball in accordance with the first trigger signal is 5 cm off from the coming-in boundary to the going-out boundary of the photographing region of the photographing unit 220 which has 26 cm of the vertical length, and when it is assumed that the maximum flight speed of the golf ball is 84 m/s, $dT_{max1}$ is about 2.5 msec based on the formula 1, and the measurable maximum rotation speed is 12,000 rpm. When it is assumed that the maximum rotation speed of the golf ball is 10,000 rpm, $dT_{max2}$ becomes 3 msec based on the formula 2. The time interval between two trigger signals based on the maximum flight speed and the maximum rotation sped of the golf ball becomes less than 2.5 msec. As the time interval between two trigger signals becomes larger, the distance that the golf all has flew between the photographing intervals based on two trigger signals increases, so as seen in the following table, the final measuring error decreases, so the time interval between two trigger signals is preferably set based on the maximum value of the time interval between the trigger signals computed by the formula 3.

TABLE 1

| | | | | | |
|---|---|---|---|---|---|
| Time interval between trigger signals (msec) | 0.5 | 1.0 | 1.5 | 2.0 | 2.5 |
| Rotation speed error when measurement error is 1° (rpm) (180° classification reference) | 333 | 167 | 111 | 83 | 67 |
| Speed error m/s) when measurement error is 0.5 mm | 1.0 | 0.5 | 0.33 | 0.25 | 0.2 |

The simulation error of Table 1 is computed by assuming that the central error of the golf ball at the going-out point of each trigger signal after image process is 0.5 mm in the flight direction of golf ball. As seen in Table 1, in case of the golf ball that was impacted at the speed of 50 m/s, when the time interval of the trigger signal is set 0.5 msec, the speed error might change between 49 m/s~51 m/s. The error of 2 m/s might have an effect on the computation of the flight distance of the golf ball. If the time interval of the trigger signal is set 2.5 mses, the speed error changes between 49.8 m/s~50.2 m/s. As the time interval of the trigger signals becomes larger, it is possible to decrease the errors when computing the flight distance of the golf ball. The above situations are applied to when computing the rotation errors in the same manner.

The number or designation method of the CCD lines designated as the active CCD lines can change in various forms if necessary. When designating the active CCD lines, it is possible to form an image scanning window formed of a K-number of CCD lines, and the M-number of CCD lines is designated at equivalent interval from the first line of the CCD lines forming the image scanning window.

Figure 8:
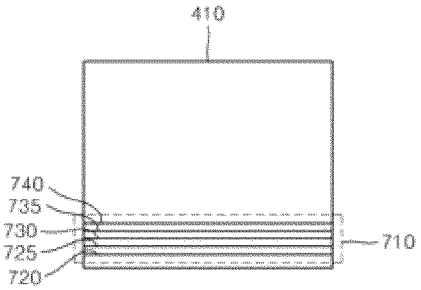
FIG. 8 is a view of an example that 33 CCD lines are set as an image scanning window, which 33 CCD lines correspond to ½ of the diameter of a golf ball in a flight direction of a golf ball among the CCD lines belonging to an image sensor adapted to a trigger signal generation unit.

FIG. 8 is a view showing an example that 33 CCD lines (in other words, K=33) corresponding ½ of the diameter of the golf ball is set as the image scanning window 710 in the flight direction of the golf ball among the CCD lines forming the image sensor 410. As shown in FIG. 8, when the image scanning window 710 is formed of 33 CCD lines (in other words, K=33), the first CCD line 720 of the image scanning window, the ninth CCD line 725, the seventeenth CCD line 730, the twenty fifth CCD lie 735 and the thirty third CCD line 740 are designated as the activated CCD lines in the flight direction of the golf ball. When the active CCD line is designated in the above manner, only the output signals of 5 CCD lines among the CCD lines forming the image senor 410 are converted into the image signals, whereby to decrease the computation load of the ND converter 425 of the image sensor 410. Consequently, the number of the frames to be photographed per second can increase from 250 frames to more than 3000 frames. In addition, it is possible to increase 5 times the possibility of the detection of the pass of the golf ball as compared to when using one active CCD line, by using the five active CCD lines as the gold ball detection line.

Figure 9:
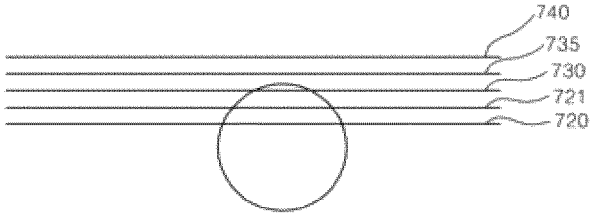
FIGS. 9 and 10 are views of the digital image signals of a golf ball positioned in an image scanning window each formed of five active CD lines and a golf ball positioned at a corresponding position.
Figure 10:
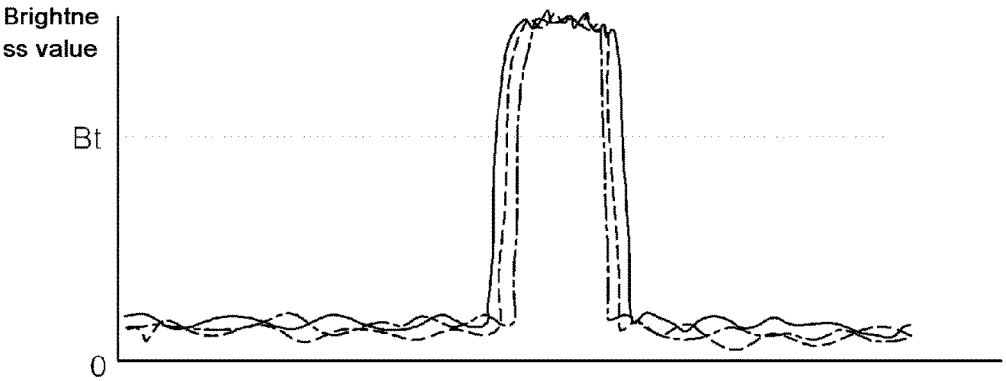

As shown in FIG. 8, when 5 CCD lines are set at equivalent intervals as the active CCD lines, the microprocessor 440 extracts the images of 5 active CCD lines (720 to 745), and analyzes the image signals per line, whereby to judge the presence of the golf ball at the active CCD line. As one example, as shown in FIG. 9, when the golf ball is positioned at 3 active CCD lines 720, 725, and 730, as shown in FIG. 10, the brightness value obtained from the photographing image is inputted into the microprocessor 440. When the image photographing cycle of the image sensor 410 is 1/3000 sec, and the maximum speed of the golf ball is 84 m/sec, the golf ball can move 28 mm for 1/3000 seconds. So, it is possible to monitor the pass of the golf ball at the time interval of 5.6 mm by judging the presence of the golf ball by means of 5 active CCD lines set at equivalent intervals in the image scanning window 710 of the size of the radius of the golf ball. The microprocessor 440 checks the pass of the golf ball in that way, and outputs a control signal to the trigger circuit 470 for allowing the trigger circuit 470 to generate the first trigger signal, and after the time interval set in the above manner has passes, the control command is outputted to the trigger circuit 470 for allowing to generate the second trigger signal.

Figure 11:
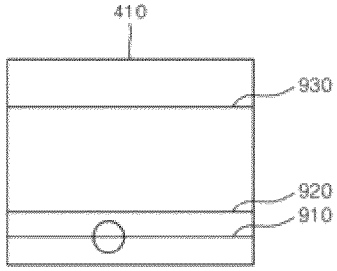
FIG. 11 is a view of an example that three CCD lines among the CCD lines belonging to an image sensor adapted to a trigger signal generation unit, are designated as an active CCD line.

FIG. 11 is a view illustrating an example that 3 CCD lines are designated as active CCD lines. As shown therein, the first active CCD line 910 is used for detecting the pass of the image acquisition region of the golf ball when impacting the golf ball. The generation procedure of the trigger signal by means of the first active CCD line 910 is the same as the procedure in which the trigger signal is generated by designating one CCD line as an active CCD line shown in FIG. 5, so the detailed descriptions thereon will be omitted. The second active CCD line 920 is set to be off by a certain distance from the first active CCD line 910 (which distance changes depending on the threshold value used for judging the low speed/high speed flight of the golf ball within the radius of 21 mm of the golf ball, and the width of the brightness used for the judgment of the golf ball). The second active CCD line 920 is used for judging the speed level of the golf ball. In other words, the microprocessor 440 computes the flight speed of the golf ball based on the interval of the detection timing of the golf ball by the first active CCD line 910 and the second active CCD line 920 and the spacing between the first active CCD line 910 and the second active CCD line 920, thus recognizing the flight state of the golf ball into the low speed mode and the high speed mode. In the above recognition of the flight modes, since the spacing between the first active CCD line 910 and the second active CCD line 920 is previously set, the microprocessor 440 judges as the low speed mode when the spacing of the detection timing of the golf ball by the first active CCD line 910 and the second active CCD line 920 is larger than the previously set reference value, and when smaller, it is judged as a high speed mode.

When the flight mode of the golf ball is judged by using the first active CCD line 910 and the second active CCD lie 920, the trigger signal generation unit 210 determines the output timing of the second trigger signal variably depending on the flight mode. For example, when it is judged that the golf ball flies at a high speed, the trigger signal generation unit 210 outputs trigger signals 2.5 msec after the first trigger signal is outputted since the golf ball is detected. When it is judged that the golf ball flies at a low speed, the trigger signal generation unit 210 outputs trigger signals 40 msec after the first trigger signal is outputted since the first active CCD line 910 has detected the golf ball. The output intervals of the trigger signals are adjusted depending on the flight mode for the following reasons. In other words, the putting among the golf impacts (namely, in case of low speed mode), the speed of the golf ball is lower as compared to the high speed move, no changes are found in the spatial position of the golf ball when the images are photographed at the same time interval as the impacts of the high speed movement. The distance that the golf ball moves for 2.5 msec is very small, so the error of the computation of the speed and rotation of the golf increases in case of putting. In order to overcome the above problems, when the golf ball at the time of putting passes through the image photographing region at a low speed, the trigger signal generation unit 210 outputs first and second trigger signals at the time intervals of 40 msec differently from the high speed mode.

The third active CCD line 930 is used as an auxiliary golf ball detection line for the occasion that the first active CCD line 910 and the second active CCD line 920 are overlapped due to the error shot by the golfer. The third active CCD line 930 might be selectively used, and operates in the same manner as the golf ball detection method as the first active CCD line 910.

FIGS. 12 to 15 are views of the images obtained by the trigger signal generation unit 210 and the brightness values in the active CCD lines. As shown therein, the images are not transmitted to an external personal computer (PC), which is prepared for real time process, when in actual use, in other words, they are transmitted to the external PC only when the trigger signal generation unit 210 is set. In addition, the positions of the active CCD lines at the left images of FIGS. 12 to 15 can be freely changed, and the size of the right side mage is 640×480 (pixels), and the threshold value of the brightness level set for the output of the trigger signal as 640×480 (pixels) and the threshold value with respect to the width of the golf ball can change if necessary.

Figure 12:
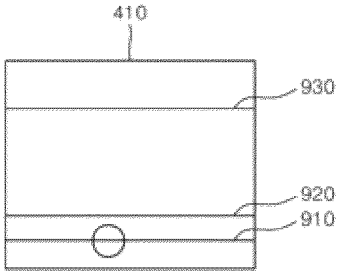
FIGS. 12 to 15 are views illustrating the brightness values of various images each obtained by a trigger signal generation unit and an active CCD line.
Figure 13:
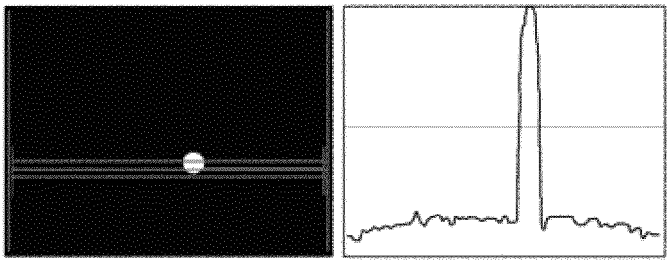
Figure 14:
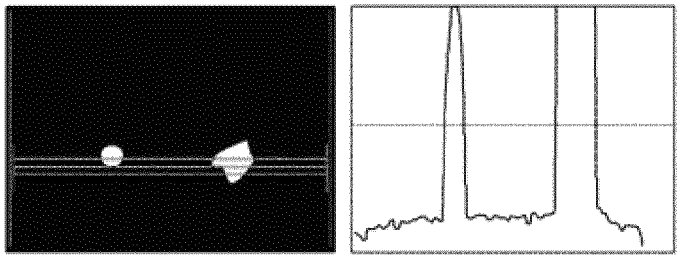
Figure 15:
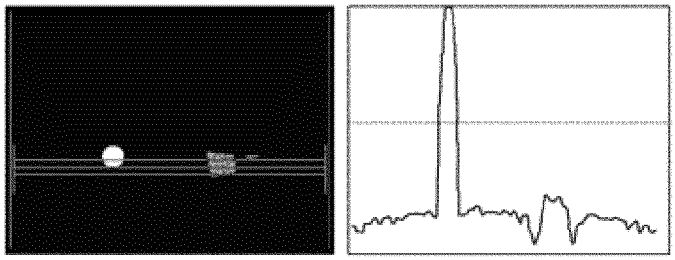

At the left side image of FIG. 12 is shown a golf ball (white circle) positioned at the horizontal line, which is the active CCD line, and a A4 size sheet (white rectangular), and at the right side image is shown the state that the brightness value corresponding to the golf ball and the A4 size sheet is higher than the threshold value of the brightness level. At the left side of FIG. 13 is shown a golf ball (white circle) positioned at the active scan line, and at the right side is shown the state that the brightness value corresponding to the golf ball is higher than the horizontal line which is the threshold value of the brightness level. The left side image of FIG. 14 is obtained by photographing the golf ball positioned at the horizontal line which is the active CCD line and the laid sand wedge, and at the right side image is shown the state that the brightness value corresponding to the gold ball and the sand wedge is higher than the threshold value of the brightness level. As shown in FIG. 14, it is known that the brightness width of the golf ball is narrower than the brightness width of the sand wedge. Finally, the left image of FIG. 15 is obtained by photographing the golf ball positioned at the horizontal line which is the active CCD line, and the laid sand wedge, and at the right side image is shown the state that the brightness vale corresponding to the golf all is higher than the threshold value of the brightness level, and the brightness value corresponding to the sand wedge is lower than the threshold value of the brightness level.

Figure 16:
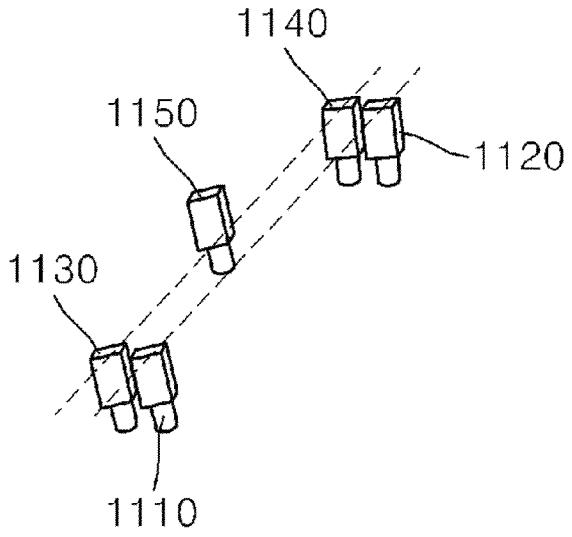
FIG. 16 is a view of an example of a photographing unit.
Figure 16:
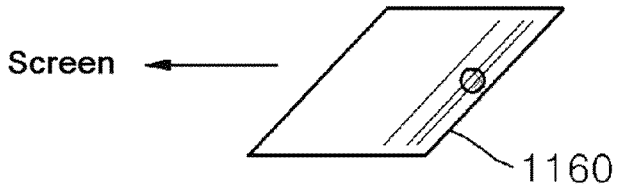

The photographing unit 220 photographs the golf ball based on the trigger signal which is inputted from the image acquisition unit 240, and transmits the photographed image signals to the image acquisition unit 240. FIG. 16 is a view of the detailed construction of the photographing unit 200. As shown in FIG. 16, the photographing unit 220 is formed of four area cameras 1110, 1120, 1130 and 1140. The four area cameras 1110, 1120, 1130 and 1140 are disposed on the ceiling in two rows between the image acquisition region 1160 and the screen. The shutter speeds of the four area cameras 1110, 1120, 1130 and 1140 are set at a high speed of 1/25000.

At this time, into each of the multiple cameras installed at each row is inputted the same trigger signal. For example, the first area camera 1110 and the second area camera 1120 among the four area cameras 1110, 1120, 1130 and 1140 are installed at the first row, and the third area camera 1130 and the fourth area camera 1140 are installed at the second row. In this configuration, the first trigger signal is, at the same time, inputted into the first area camera 1110 and the second area camera 1120 installed at the first row close to the image acquisition region 1160, and the second trigger signal is, at the same time, inputted into the third area camera 1130 and the fourth area camera 1140 installed at the second row. The area camera 1150 acting like the trigger signal generation unit 210 is installed at the center of the four area cameras 1110, 1120, 1130 and 1140. The distance from the first area camera 1110 and the image acquisition region and the distance from the second area camera 1120 and the image acquisition region are set same. The distance from the third area camera 1130 and the image acquisition region 1160 and the distance from the fourth area camera 1140 and the image acquisition region 1160 are set same. It is preferred that the image acquisition regions 1160 of the four area cameras 1110, 1120, 1130 and 1140 provided at the photographing unit 220 are matched.

Figure 17:
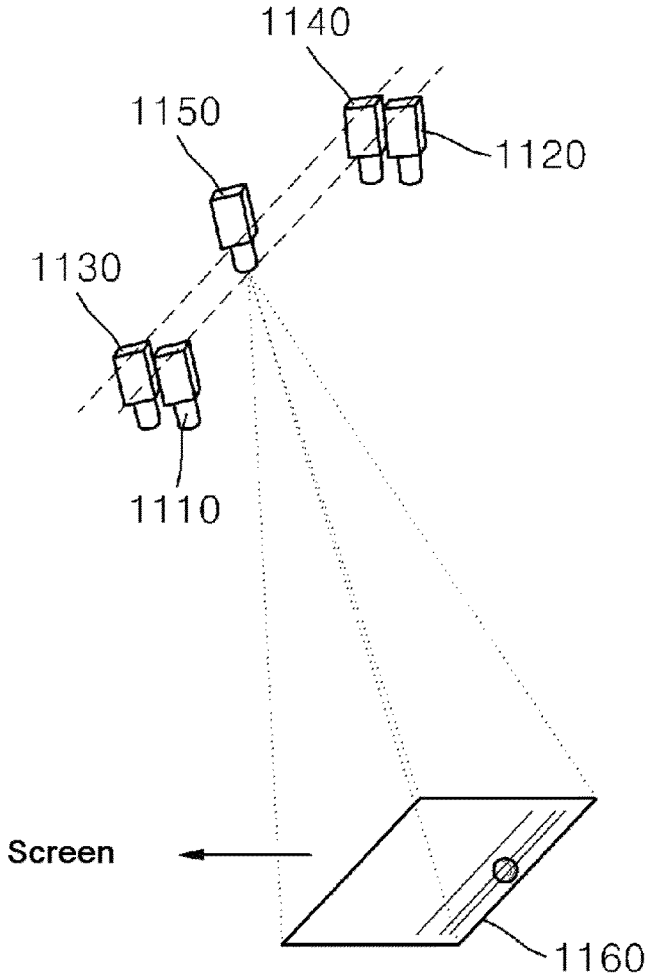
FIGS. 17 to 19 are views illustrating an image photographing procedure by an area camera provided at a trigger signal generation unit, an image photographing procedure by the first area camera and second area camera arranged at a first row, and an image photographing procedure by the third area camera and the fourth area camera arranged at the second row.
Figure 18:
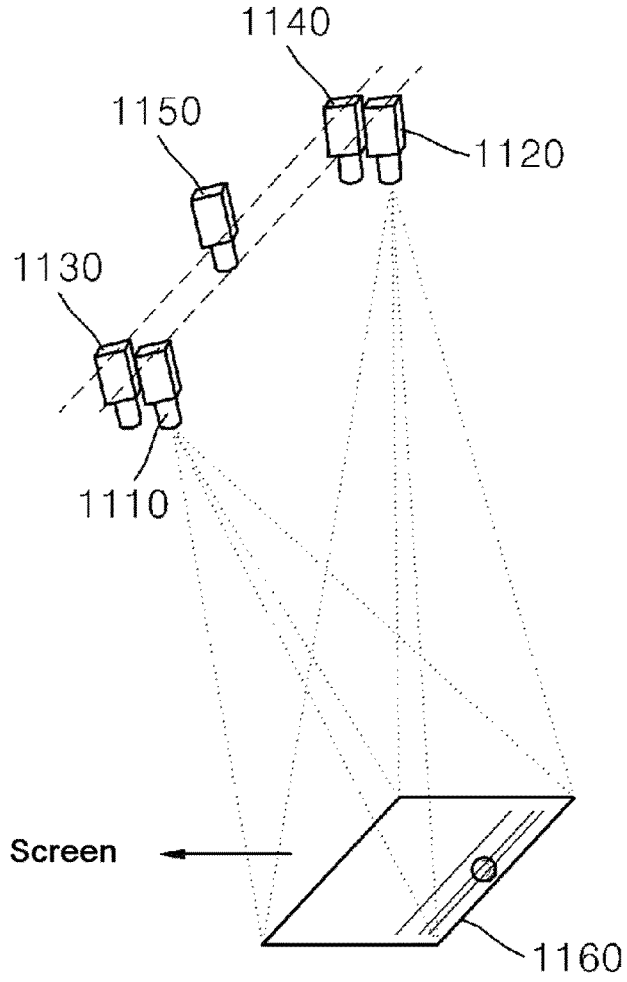
Figure 19:
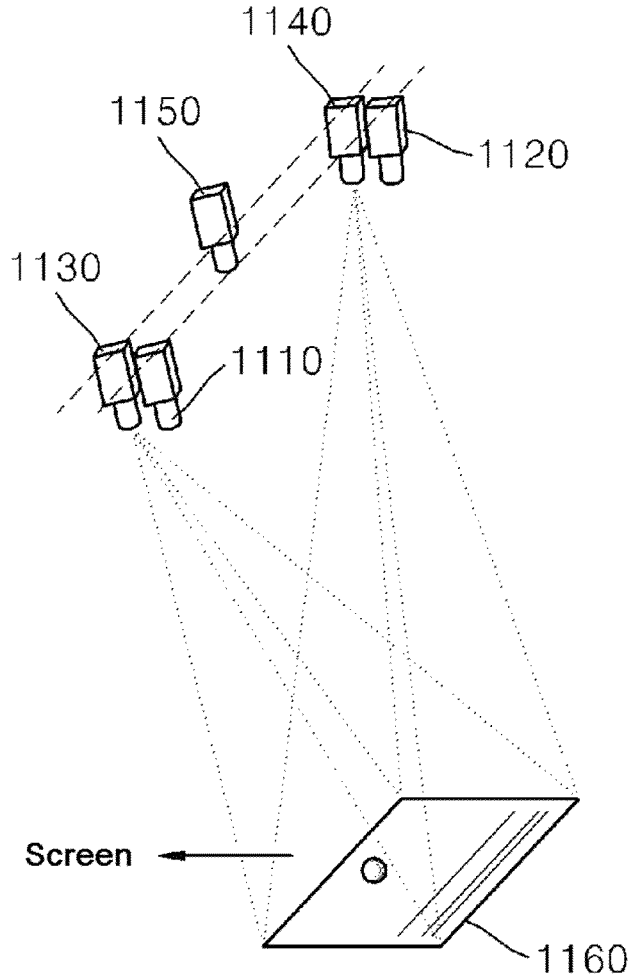

The photographing procedure by the photographing unit 220 will be described. First, when the first trigger signal outputted from the trigger signal generation unit 210 is, at the same time, inputted into the first area camera 1110 and the second area camera 1120 disposed at the first row via the frame grabber disposed at the image acquisition unit 240, the first area camera 1110 and the second area camera 1120 photograph images, and output to the frame grabber disposed at the image acquisition unit 240. Next, the second trigger signal outputted from the trigger signal generation unit 210 is, at the same time, inputted into the third area camera 1130 and the fourth area camera 1140 disposed at the second row via the frame grabber disposed at the image acquisition unit 240, the third area camera 1130 and the fourth area camera 1140 photograph the mages and transmit to the frame grabber provided at the image acquisition unit 240. FIGS. 17 and 19 are views of the image photographing procedures by the area camera 1150 disposed at each trigger signal generation unit 210, the first area camera 1110 and the second area camera 1120 disposed at the first row, and the third area camera 1130 and the fourth area camera 1140 disposed at the second row.

When an area camera capable of, at the same time, photographing at least two sheets within 2.5 msec is provided at the photographing unit 220, the area cameras might be installed at left and right sides of the trigger signal generation unit 210, totally two area cameras are installed. When constructing the photographing unit 220 in the above manner, the photographing regions of two area cameras are same, and each trigger signal is, at the same time, inputted into two area cameras, respectively.

The lighting unit 230 is formed of a lighting device emitting continuous light which maintains uniform brightness. The lighting device belonging to the lighting unit 230 is installed in the vicinity of the photographing unit 220, in other words, it is installed at the outer sides of the first area camera 1110 and the fourth area camera 1140, respectively, and is installed at the outer sides of the second area camera 1120 and the third area camera 1130, respectively. The lighting device belonging to the lighting unit 230 preferably has a light widening angle for lighting wider regions than the image photographing region 1160, and the minimum brightness at the image photographing region 1160 preferably has higher than 5000 Lux.

The image acquisition unit 240 transmits the trigger signal inputted from the trigger signal generation unit 210 to the photographing unit 220, and stores the images from the photographing unit 220, and provides to the information measuring unit 250. The image acquisition unit 240 is formed of a frame grabber, and performs the functions like a sync signal provision function, a trigger signal provision function, an image storing function, etc. with respect to the photographing unit 220. The image acquisition unit 240 provides the cameras of the photographing unit 220 with sync signals, respectively. Next, when the first trigger signal is inputted from the trigger signal generation unit 210, the trigger signal is, at the same time, inputted into the first area camera 1110 and the second area camera 1120, and when the second trigger signal is inputted from the trigger signal generation unit 210, the trigger signal is, at the same time, inputted into the third area camera 1130 and the fourth area camera 1140, respectively. The image acquisition unit 240 converts the images inputted from each area camera into digital images and stores the same. The images from the photographing unit 220 are converted into digital images by the frame grabber, and are stored in the storing medium disposed at the frame grabber or in an external storing medium. In addition, the stored digital images are inputted into the information measuring unit 250.

The information measuring unit 250 computes the flight parameter (in other words, flight speed, flight direction, rotation direction, rotation axis, etc) of the golf ball in the space from the digital images provided from the image acquisition unit 240 by driving the image process program which is installed. The information measuring unit 250 detects the center of the golf ball from each digital image, and detects the position of the golf ball in the space corresponding to the first photographing pointing and the second photographing pointing and the position of the point indicted at the surface of the golf ball, which detections are performed based on the stereo calibration technology. Next, the information measuring unit 250 serves to compute the flight parameter such as the speed of golf ball, moving direction, rotation speed and rotation angle based on the position of the golf ball in the space detected in response to the first photographing timing and the second photographing timing, and the position of the point indicated at the surface of the golf ball. In addition, the information measuring unit 250 resolves the solutions of the kinetic equations from the flight parameter of the golf ball in consideration with the drag, rotation, etc., whereby to compute the trajectory of the golf ball.

The technology used to compute the flight parameter of the golf ball with the aid of the information measuring unit 250 is a stereo calibration technology for recognizing a spatial position and a rotation information computation technology of the golf ball. The stereo calibration technology and the rotation information computation technology of the golf ball according to the present invention will be described in details.

Figure 20:
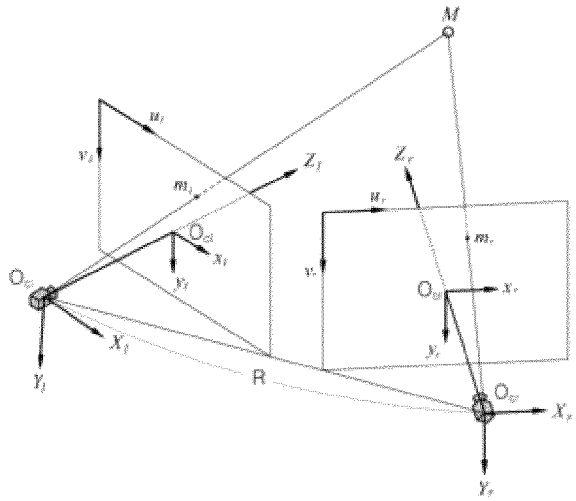
FIGS. 20 and 21 are views illustrating a principle of a stereo calibration technique and a camera calibration tool which is in current use.

The stereo calibration technology is directed to measuring an accurate position in the space by using the information obtained using the images of at least two images, and the information measuring unit 250 computes the position and rotation degree of the golf ball with the aid of the stereo calibration technology. FIG. 20 is a view of the principle of the stereo calibration technology. As shown in therein, two cameras 1310 and 1320 are needed to recognize the position point M in the space by the stereo calibration. When two installation information of the cameras 1310 and 1320 (the spatial coordinates $O_{cl}$ and $O_{cr}$ of two cameras, the length of the distance T-reference line between two cameras, and the angle R between two cameras about the focus distance of two cameras), it is possible to obtain the spatial positions of the point M from the points $m_l$ and $m_r$ which match with the spatial position point M in the images 1315 and 1325 photographed by two cameras 1310 and 1320. The stereo calibration is performed over two stages. The matching points representing the same points in the 3D space between two images taken by the cameras 1310 and 1320 is searched. What the matching points are searched from two images is called the image matching. Next, a 3D structure is recovered based on the principle that the coordinates of the given 3D points means a crossing between the light reflected from the center of the camera and the point matching with each image, which process is called reconstruction.

In order to actually apply the above stereo calibration technology, the camera calibration is needed with respect to two left and right cameras. Here, the camera calibration might be expressed as a procedure of obtaining a relative formula between the point M of the 3D positioned in the space and the point m of the 2D formed as the point M is expressed on the camera image.

$$\tilde{m}=P\tilde{M} \qquad \text{Formula 4}$$

where $\tilde{m}$ represents the puncture coordinate of the 2D, and $\tilde{M}$ represents the puncture coordinate of the 3-dimension, and P represents a camera pconversion matrix.

Figure 21:
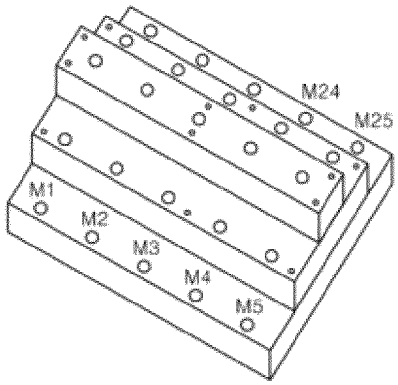

The camera calibration is conducted using a calibration tool to which indicators on the positions in the space are attached. Here, the calibration tool is positioned at the portion where needs the 3D image recovery, and the image of the calibration tool is obtained using the camera, and the camera conversion matrix is obtained using the positoons of the iniators at the calibration tool and the positions of the indicators of the image. FIG. 21 is a view of the currently available camera calibration tool. As shown in FIG. 21, the black circle represents the indicator, and the camra calibration is performed using the centeral coordinates of the black circle. The indicator needs at least six indicators positioned in different space, and it is prefeered that such indicators are unifomly distbituted over the region where needs the 3D image recovery. The error of the indicator coordinates has an effect on the error of the spatial coordnate obtained by the 3D image recovery, so the error should be within 0.1 mm in maximum. The above-described stereo calibration technique and the camera calibration are known to a person of ordinary skill, so the detailed descriptions thereon will be omitted.

The rotation information of the golf ball according to the present invention is computed based on a specific pattern printed on the golf ball. One method among the conventional methods for computing the rotation information of the golf ball is characterized in that the center of the golf bal at the surface of the golf ball is assumed as the center of the cicle, and a plurality of mark lines having a crossing point connecting two points on the surface of the golf ball are printed and photographed at a high speed by the camera, thus computing the rotation informton of the golf ball. In the above conventional method, when the rotation angle of the golf ball is above 120°, since it is impossible to judge the rotation direction of the golf ball, it is needed to photograph two images before the golf ball rotates above 120°. In addition, another method among the conventional methods for computing the rotation information of the golf ball is directed to computing the rotation information of the golf ball by printing a plurality of punctures on the surface of the golf ball and photographing, at a high speed, the same. This method cannot judge the rotation direction of the golf ball when the rotation angle of the golf ball is above 180°, it is needed to photograph two images before the golf ball rotates above 180°. Since the conventional golf ball rotation information computation methods do not consider the problems of the rotation direction based on the rotation angle of the golf ball, expensive high-speed cameras should be adapted in order to accurately measure the rotation angle of the golf all.

As compared to the above conventional art, the trigger signal generation unit 210, which generates trigger signals, according to the present invention outputs the first trigger signal in consideration with the maximum flight speed and the maximum rotation speed of the golf all and then outputs a second trigger signal before the golf ball rotates more than 180°, whereby to measure the accurate rotation information of the golf ball. The present invention is basically directed to measuring the rotation information of the golf ball by using the golf ball on which surface the marking patterns are printed so different patterns can be seen in all directions. The marking pattern might be formed of punctures or lines.

Figure 22:
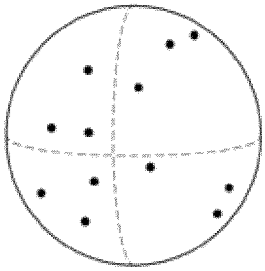
FIGS. 22 to 25 are views of an example of various marking patterns printed on the surface of each golf ball.
Figure 23:
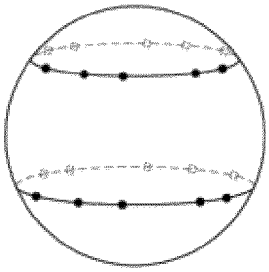

When the marking patterns are formed of punctures, as shown in FIG. 22, the marking punctures are printed on the surface of the golf ball so that each triangle made by selecting three punctures becomes different from each other (in other words, the shape and size of each triangle become different from each other). When such marking punctures are to be used, the surface of the golf ball is divided into equivalent regions, and three punctures are printed on each region to have different arrangements. When the marking patterns are formed of punctures, as shown in FIG. 23, the marking punctures might be printed along an imaginary circle in which each axis of the upper sphere and the lower sphere of the golf ball is matched, and the diameters are different from each other. At this time, the marking punctures printed along each imaginary circle are arranged in such a manner that each imaginary circle is divided into four parts each having an arc, and the opposite arcs have marking punctures in different numbers or different intervals. When the marking patterns are formed of punctures, image process is easy, and it is possible to advantageously know the spatial position based on the stereo calibration method based on only the computation of the center of the punctures. Various pattern printings are possible, and even when punctures are photographed unclear due to the scattering of light, it is possible to compute the rotation information the remaining clear punctures in such a way to print a plurality of punctures.

Figure 24:
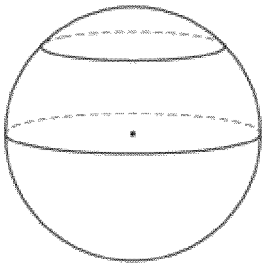
Figure 25:
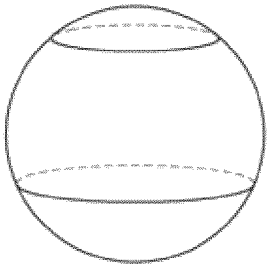
Figure 26:
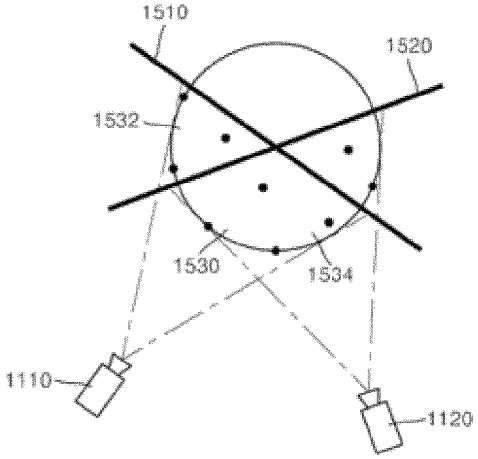
FIGS. 26 to 29 are views of a procedure of computing a rotation vector of a golf ball from an image photographed by an area camera arranged at a first row.
Figure 27:
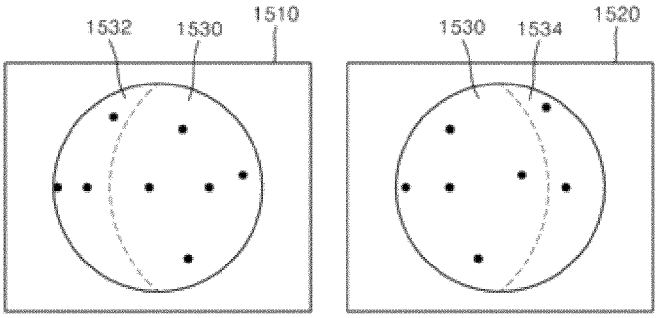

When the marking patters are formed of lines, as shown in FIG. 24, the first circle having the center of the golf ball as a circle center is printed on the surface of the golf ball, and the second circle of which diameter is smaller than the diameter of the first circle is printed on the golf ball, not crossing with the first circle. When the marking patterns are formed of lines, as shown in FIG. 25, it is possible to print, on the upper sphere and the lower sphere of the golf ball, different circles with different diameters. When the circles are printed on the surface of the golf ball in the above manner, different patterns can be always seen in all direction. The above marking patterns might be printed along with infrared ray paint so that the user cannot recognize. In this case, the cameras might be changed with infrared ray cameras or might be changed with cameras having high sensitivity at the infrared ray region. The marking patterns printed on the surface of the golf ball might be formed of many different methods. It is obvious that any construction making the patterns to look differently in the golf ball might be in the scope of the present invention.

The method for measuring the rotation information of the golf ball according to the present invention will be described.

The present invention is basically directed to computing the rotation of the golf ball by analyzing the patterns of the punctures printed on the surface of the golf ball in the images photographed by using two cameras 1110 and 1120, and 1130 and 1140 arranged at the same row when trigger signals are inputted by using four cameras 1110, 1120, 1130 and 1140 in order to compute the rotation information of the golf ball. In other words, when the first trigger signal generated by the trigger signal generation unit 210 which has detected the golf ball is inputted into the first area camera 1110 and the second area camera 1120, the first area camera 1110 and the second area camera 1120 photograph the images of the golf ball, and certain time period passes since the first trigger signal is generated, and then when the second trigger signal generated by the trigger signal generation unit 210 is inputted into the third area camera 1130 and the four area camera 1140, the third area camera 1130 and the fourth area camera 1140 photograph the images of the golf ball.

FIGS. 26 to 29 are views of the procedures for computing the rotation information of the golf ball from the images of the golf ball in the images photographed by the first area camera 1110 and the second area camera 1120. As shown in FIGS. 26 to 29, since two area cameras 1110 and 1120 are spaced apart from each other, the images photographed by each camera are different. At this time, the surface region of the golf ball consists of a region 1530 which is contained in the image 1510 of the golf ball photographed by the first area camera 1110 positioned at the left side when viewing the golf ball and in the image 1520 photographed by the second area camera 1120 positioned at the right side, a region 1532 which is contained in the image 1510 photographed by the first area camera 1110, a region 1532 which is contained in the image 1510 of the golf ball photographed by the first area camera 1110, and a region 1534 which is contained in the image 1510 of the golf ball photographed by the second area camera 1120. The images of the golf balls photographed by the third area camera 1130 and the fourth area camera 1140 have the same construction.

Figure 28:
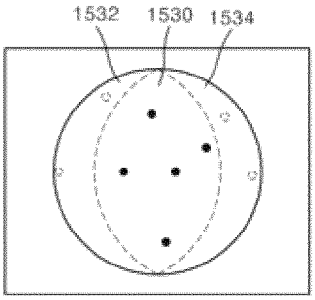
Figure 29:
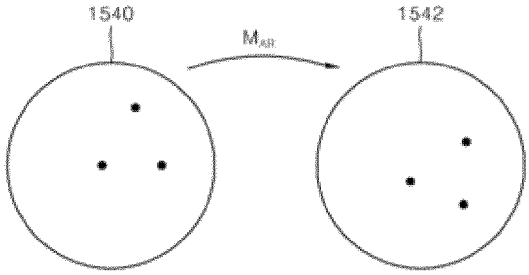

The information measuring unit 250 serves to compute the coordinates of the 3D space by adapting the stereo calibration technology with respect to the marking points existing in the region 1530 common in each golf ball image photographed at the same time by two cameras 1110 and 1120 arranged at the first row. The information measuring unit 250 also computes, by using the spherical equation of the golf ball and the position information of the camera, the spatial coordinates of the marking points existing in the regions 1532 and 1534 not photographed at the same time by the firs area camera 1110 and the second area camera 1120. FIG. 28 is a view of the marking points detected with respect to the golf ball corresponding to the first trigger signal.

Next, the information measuring unit 250 serves to detect the reference pattern 1542 same as the shape 1540 formed of the marking points numbered as many as the previously set number (for example, 3) among the spatial coordinates with respect to the marking points of the golf ball obtained from the golf ball image photographed from different viewpoints among the reference pattern data which are previously stored. Here, the reference pattern data are the coordinates of the marking points forming random polygonal shapes (the set number is 3, it means a triangle) which might be formed by the marking points printed on the surface of the golf ball obtained after the center of the golf ball is positioned at the zero point of the 3D coordinate.

Next, the information measuring unit 250 computes the conversion matrix (matrix which adapts the change of roll angle, yaw angle and pitch angle as factors) to match the marking points selected as many as the previously set number, with the same reference pattern 1542. At this time, in order to compute the accurate rotation information, at least five marking points are needed in the common region 1530, and the information measuring unit 250 selects at least five marking points among the marking points residing in the common region 1530, and the detection of the reference pattern and the computation of the conversion matrix are repeatedly performed with respect to 10 triangles which might be formed of the selected marking points. If the marking points residing in the common region 1530 is less than 5, the additional marking points in the regions 1532 and 1534 residing in each golf ball image 1510 and 1520 are selected, thus allowing at least 5 marking points to be selected. The marking points residing in the common region 1530 are first selected because such marking points are characterized in that the spatial coordinates of the marking points photographed by two cameras 1110 and 1120. The conversion matrix, which has minimum error values computed by the following formula among 10 conversion matrixes obtained via repetitive computation, is determined as the first conversion matrix.

$$\text{Error} = \frac{\sum_{i=0}^{n-1} D_i}{n} \qquad \text{Formula 5}$$

where Di represents a distance between the marking points forming the detected reference pattern matching with a coordinate value in a 3D space of each of three marking points randomly selected among a n-number of the marking points and each coordinate value in the 2D space obtained by converting the remaining two marking points based on the conversion matrix computed with respect to the randomly selected 3 marking points and can be expressed in the following formula.

$$D_i = \sqrt{(P_x[i] - Pr_x[Idx[j]])^2 + (p_y[i] - Pr_y[Idx[j]])^2 + (p_z[i] - Pr_z[Idx[j]])^2} \qquad \text{Formula 6}$$

where $P_{x,y,z}[i]$ represents the coordinate of each marking point, and $Pr_{x,y,z}[Idx[j]]$ represents the coordinate of the marking point of the reference pattern matching with each $P_{x,y,z}[i]$.

At this time, the method for determining the first conversion matrix might be a method which obtains an average value of the conversion matrix which is repeatedly computed, a method which obtains an average of the conversion matrix in which an error value exists in a certain range, etc. The information measuring unit 250 computes the rotation angle (in other words, roll angle, yaw angle and pitch angle) of the golf ball matching with the first trigger signal from the first conversion matrix. When the first conversion matrix $M_{AR}$ representing the rotation information of the golf ball is determined from the golf ball image photographed in accordance with the first trigger signal via the above procedure, the information detection unit 250 determines the second conversion matrix $M_{BR}$ representing the rotation information of the golf ball from the images photographed by the third area camera 1130 and the fourth area camera 1140 in accordance with the second trigger signal.

Figure 30:
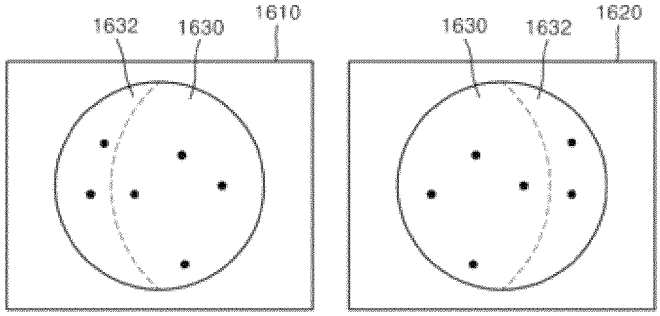
FIGS. 30 to 32 are views of a procedure of computing a rotation vector of a golf ball from an image photographed by an area camera arranged at a second row.
Figure 31:
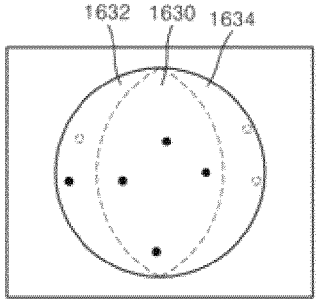
Figure 32:
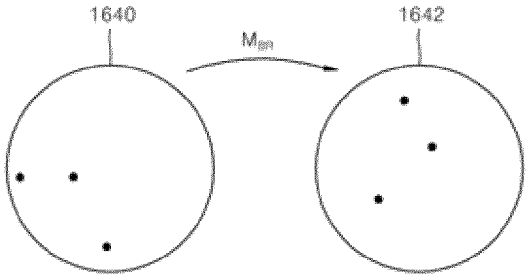

FIGS. 30 to 32 are views of the procedures that the information measuring unit 250 determines a second conversion matrix. As shown in FIGS. 30 to 32, the information measuring unit 250 computes the coordinates in the 3D space based on the stereo calibration technique with respect to the marking points residing in the common region 1630 in each golf ball image photographed, at the same time, by two cameras 1130 and 1140 arranged at the second row. Here, the information measuring unit 250 computes the space coordinates of the marking points residing in the regions 1632 and 1634 not photographed at the same time by the third area camera 1130 and the fourth area camera 1140, by using the spherical equation of the golf ball and the position information of the camera. Next, the information measuring unit 250 detects the reference pattern 1642 same as the shape 1640 formed of the marking points numbered as many as a previously set number (for example, 3) among the space coordinates with respect to the marking points of the golf ball obtained from the golf ball image photographed at different viewpoints among the reference pattern data previously stored in the same manner as the process procedure with respect to the images photographed in match with the first trigger signal. At this time, as shown in FIG. 31, since four marking points exist in the common region 1630, an additional marking point is selected from the region 1632 residing only in the golf ball image that the third area camera 1130 has photographed among the regions 1632 and 1634 residing only in each golf ball image 1610, 1620, so at least five marking points are selected. Next, the information measuring unit 250 repeatedly performs the detection of the reference pattern and the computation of the conversion matrix with respect to each of 10 triangles which each might be formed of 5 selected marking points. The information measuring unit 250 determines the conversion matrix having the minimum error value among 10 repeatedly computed conversion matrixes, as the second conversion matrix $M_{BR}$ matching with the second rigger signal.

When the first conversion matrix $M_{AR}$ and the second conversion matrix $M_{BR}$ which represent the rotation information of the golf ball are determined from the golf ball image photographed in accordance with the first trigger signal and the second trigger signal via the above procedures, the information measuring unit 250 computes the final conversion matrix $M_{AB}$ from the conversion matrix $M_{AR}$ with respect to the golf ball in the image photographed by the first trigger signal based on the following formula and the conversion matrix $M_{BR}$ with respect to the golf ball in the image photographed based on the second trigger signal.

$$M_{AB}=M_{AR}\cdot M_{BR}^{-1} \quad \text{Formula 7}$$

The information measuring unit 250 computes the rotation information (rotation speed and rotation axis) of the golf all formed between two photographing points from the final conversion matrix obtained based on the formula 7. The information measuring unit 250 might compute the flight trajectory and the bounding information of the golf ball by using the given environmental variable the flight parameter and the rotation information of the golf ball. At this time, the environmental variable includes a geographical information of the entire holes (kinds of geography such as fairway, rough, etc., and density of geography, slope of geography, etc), atmospheric information for the flight of golf ball (humidity, air density, wind direction, wind power, drag coefficient, lift coefficient, etc).

Figure 33:
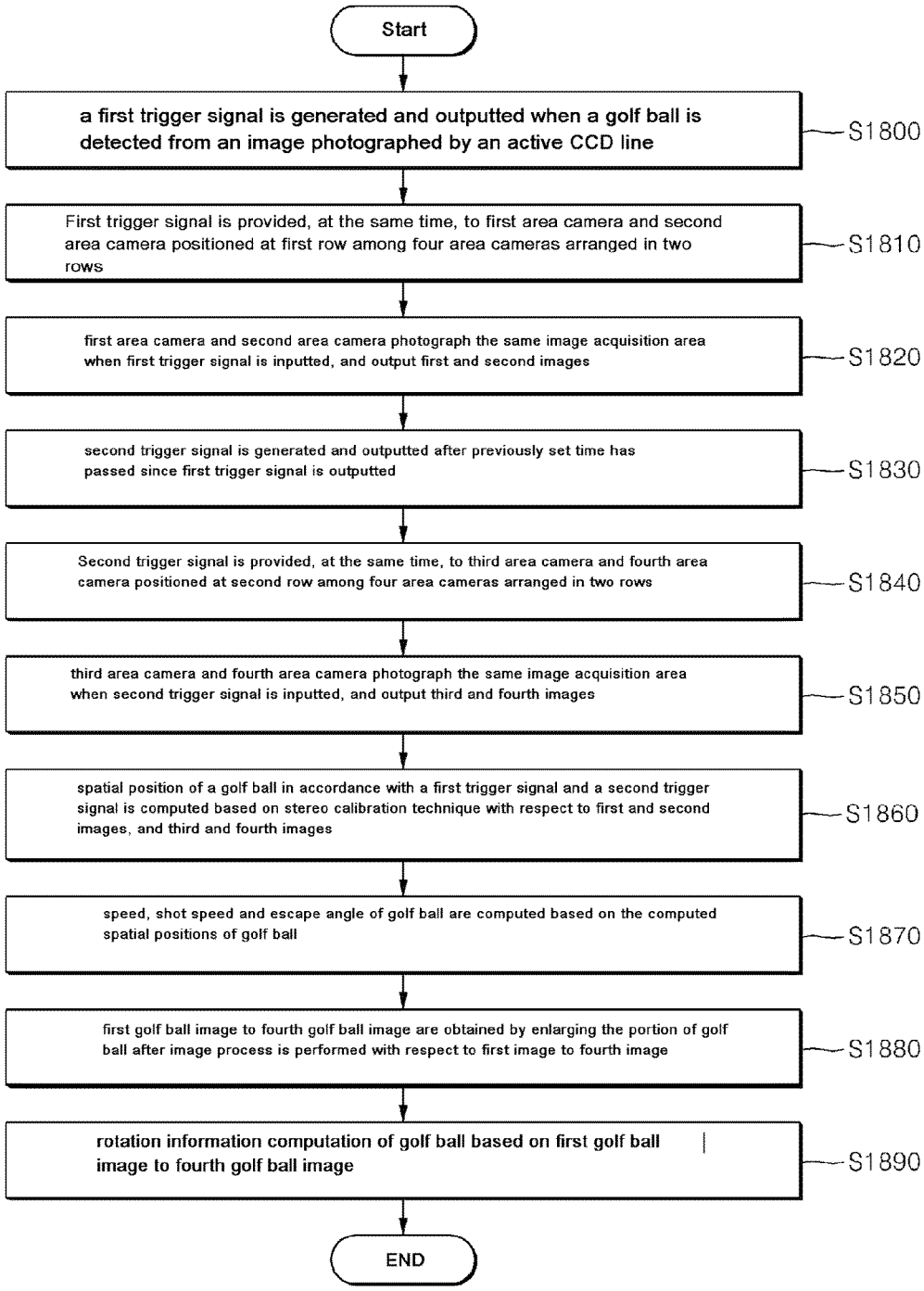
FIG. 33 is a flow chart of a procedure of a method for measuring flight parameters of a spherical object according to a preferred embodiment of the present invention.

FIG. 33 is a flow chart of a procedure of a method for measuring the flight parameter of a spherical object according to a preferred embodiment of the present invention.

Figure 34:
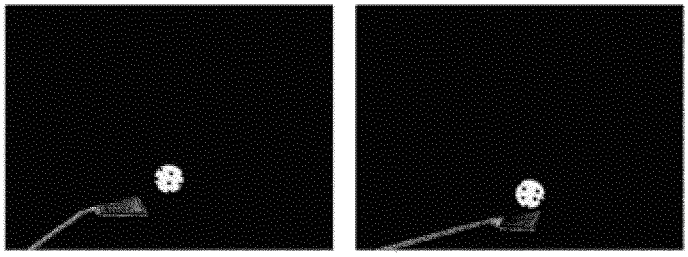
FIGS. 34 and 35 are views of the examples of a first image and a second image corresponding to a first trigger signal and a third image and a fourth image corresponding to a second trigger signal.
Figure 35:
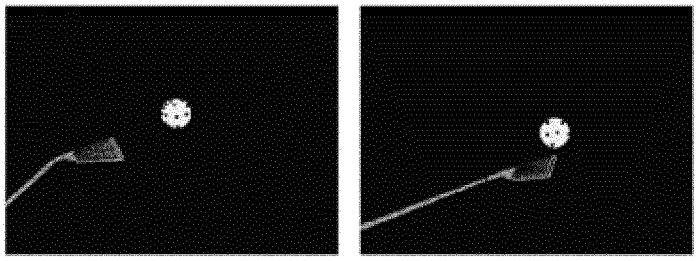

As shown in FIG. 33, the trigger signal generation unit 210 generates a first trigger signal when a golf ball is detected from the mage photographed by the active CD line and outputs an image acquisition unit 230 in a step S1800. The image acquisition unit 240 provides, at the same time, a first trigger signal to the first area camera 1110 and the second area camera 1120 arranged at the first row among four area cameras arranged in two rows forming the photographing unit 220 in a step S1810. The first area camera 1110 and the second area camera 1120 photograph the same image acquisition regions when a first trigger signal is inputted and outputs the first image and second image to the image acquisition unit 240 in a step S1820. FIG. 34 is a view of a first image and a second mage in accordance with a first trigger signal. Next, the trigger signal generation unit 210 generates a second trigger signal after a previously set time interval (for example, 2.5 msec) has passed from since the first trigger signal is outputted and outputs to the image acquisition nit 240 in a step S1830. The image acquisition unit 240 provides, at the same time, the second trigger signal to the third area camera 1130 and the fourth area camera 1140 positioned at the second row among four area cameras arranged in two rows forming the photographing unit 220 in a step S1840. The third area camera 1130 and the fourth area camera 1140 photograph the same image acquisition regions when the second trigger signal is inputted and outputs to the image acquisition unit 240 in a step S1850. FIG. 35 is a view of a third image and a fourth image in accordance with a second trigger signal.

Figure 36:
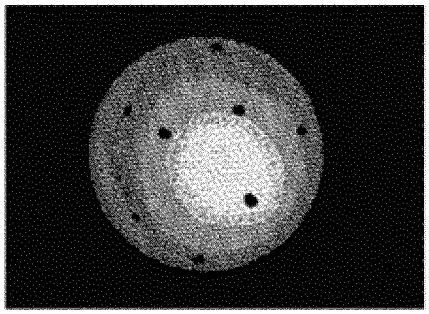
FIG. 36 is a view of an example of a golf ball image obtained after image process.

The information measuring unit 250 computes a spatial position of the golf ball corresponding to a first trigger signal and second trigger signal based on the stereo calibration technique with respect to the first image and second image, and the third image and fourth image in a step S1860. The information measuring unit 250 computes a speed of a golf ball, a launch angle and a deviation angle of a golf ball based on the computed spatial position of the golf ball in a step S1870. Next, the information measuring unit 250 obtains a first golf ball image to a fourth golf ball image by enlarging the golf ball after image processes (noise removal, boundary detection) are performed with respect to the first image to the fourth image in a step S1880. FIG. 36 is a view of a golf ball image obtained after image process. The information measuring unit 250 computes the rotation information of the golf ball based on the first golf ball image to the fourth golf ball image in a step S1890.

Figure 37:
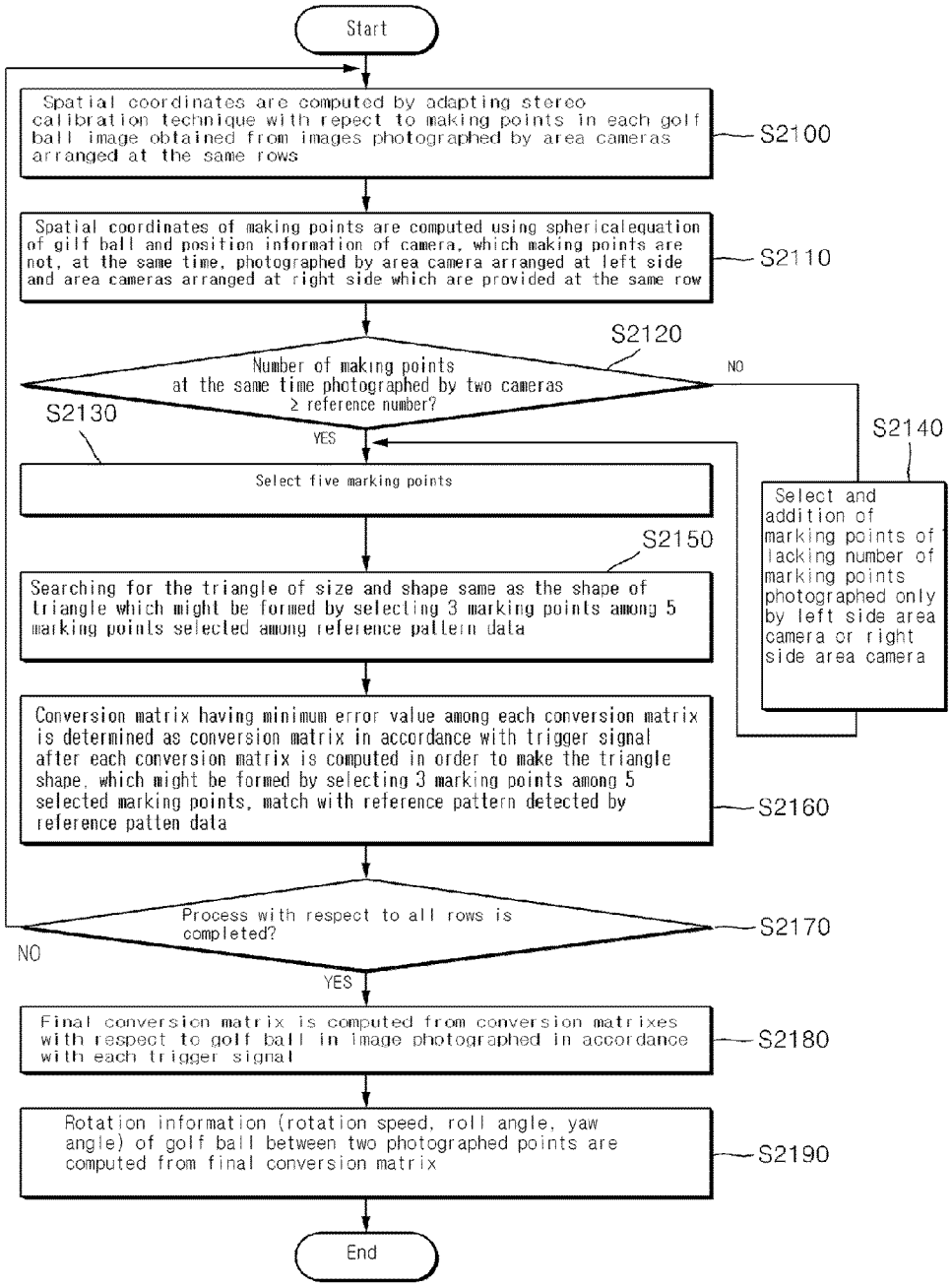
FIG. 37 is a flow chart of a procedure of computing a rotation information of a golf ball by means of an information measuring unit.

FIG. 37 is a flow chart of a procedure for computing the rotation information of a golf ball by means of the information measuring unit 250.

As shown in FIG. 37, the information measuring unit 250 computes the coordinates of space by adapting the stereo calibration technique with respect to the marking points in each golf ball image obtained from the images photographed by the area camera 1110, 1120 arranged in the first row in a step S2100. Next, the information measuring unit 250 computes the coordinates of the space of the marking points not photographed, at the same time, by the first area camera 1110 and the second area camera 1120 based on the spherical equation of the golf ball and the position information of the camera in a step S2110. Next, the information measuring unit 250 selects 5 marking points among the corresponding marking points in a step S2130 when the number of the marking points photographed, at the same time, by the first area camera 1110 and the second area camera 1120 is more than a previously set reference number (for example, 5) in a step S2120. If the number of the marking points photographed, at the same time, by the first area camera 1110 and the second area camera 1120 is less than the previously set number (for example, 5) in a step S2120, the lacking marking points among the marking points photographed only by the first area camera 1110 or the second area camera 1120 are selected and added in a step S2140. The information measuring unit 250 searches for the triangles having the same dimensions and shapes as the triangles which might be formed by selecting 3 marking points among 5 marking points selected in the reference pattern data in a step S2150. Next, the information measuring unit 250 computes each conversion matrix ($M_{AR1}$ to $M_{AR10}$ for matching each triangle, which might be formed by selecting 3 marking points among the selected 5 marking points, with the reference pattern detected among the reference pattern data, and determines the conversion matrix as the final first conversion matrix $M_{AR}$ which represents the rotation information of the golf ball from the golf ball image photographed in accordance with the first trigger signal so that the error value expressed in Formula 5 among the computed first conversion matrixes can be minimized in a step S2160.

Figure 38:
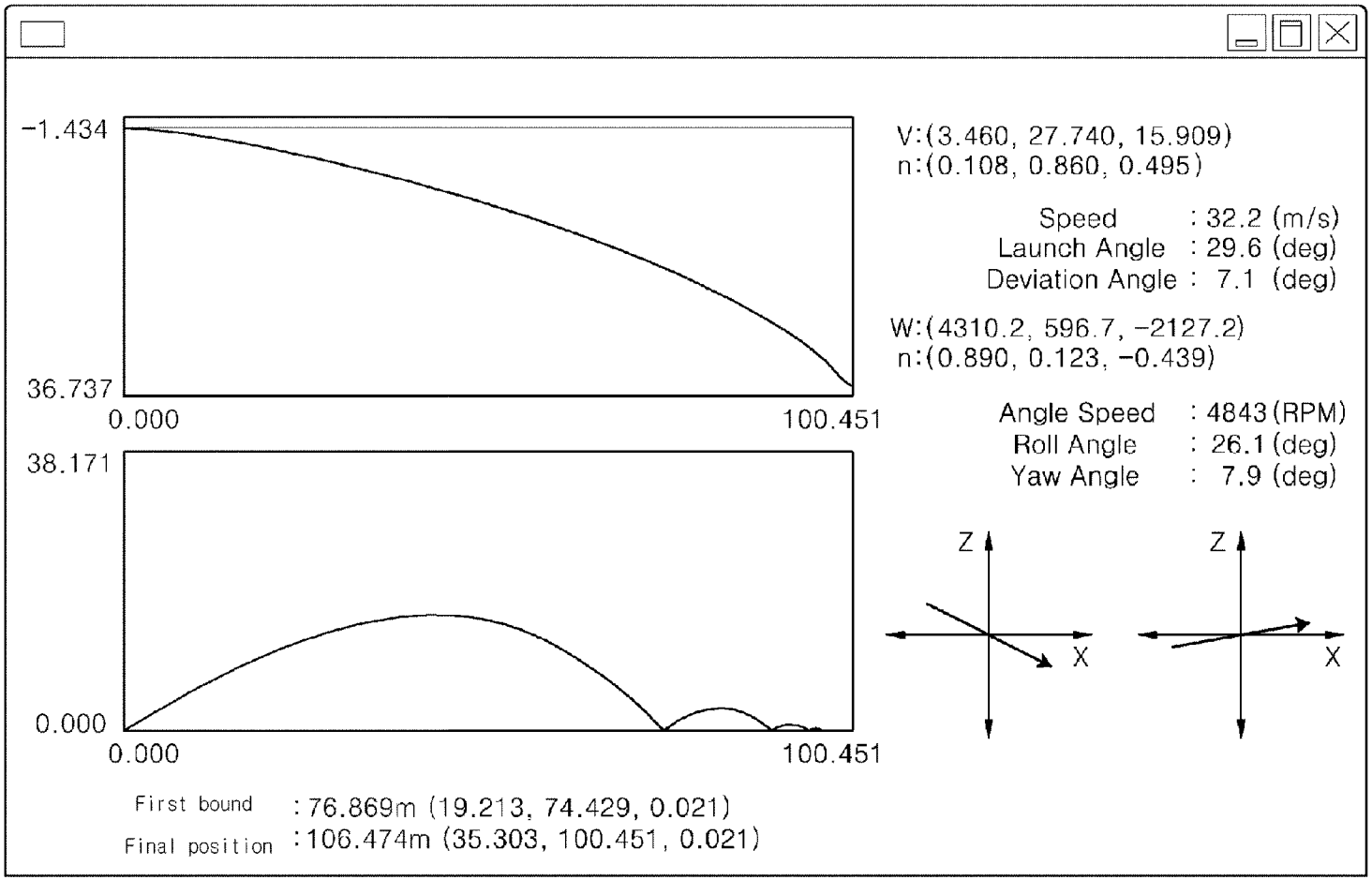
FIG. 38 is a view of an example of a user interface screen with a flight information and rotation information of a golf ball and a flight trajectory of a golf ball which are all computed by an information measuring unit.

The above steps S2100 to S2160 are sequentially performed with respect to the images photographed by the area cameras 1130 and 1140 arranged at the second row, thus determining the second conversion matrix $M_{BR}$ in a step S2170. Next, the information measuring unit 250 computes by using the formula 7, the final conversion matrix $M_{AB}$ from the conversion matrix $M_{AR}$ with respect to the golf ball in the image photographed by the first trigger signal and the conversion matrix $M_{BR}$ with respect to the golf ball in the image photographed by the second trigger signal in a step S2180. Next, the information measuring unit 250 computes the final conversion matrix obtained based on Formula 7 and the rotation information (rotation speed and rotation axis) of the golf ball between two photographing timings at the time interval of each trigger signal in a step S2190. In addition, the information measuring unit 250 might compute the flight trajectory and the bounding information of the golf ball by using the given environment variable and the computed flight parameter and rotation information of the golf ball. FIG. 38 is a view of the flight parameter and rotation information of the golf ball computed by the information measuring unit 250 and the fight trajectory of the golf ball.

The present invention can be implemented in the form of a recording medium readable by a computer with the aid of a code which is readable by the computer. The recording medium readable by the computer includes all kinds of recording devices which are capable of storing data readable by the computer system. As an example of the recording medium readable by the computer, there are ROM, RAM, CD-ROM, magnetic tape, floppy disk, optical data storage, etc. and further includes a carrier wave (for example, transmission via internet). The recording medium readable by the computer might be distributed to the computer system connected via the network, so the codes readable by the computer are stored and executed based on the distribution way.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A system for measuring flight parameters of a spherical object, comprising:

a trigger signal generation unit which generates and outputs a first trigger signal when a spherical object is detected, and generates and outputs a second trigger signal when a reference time interval set based on the maximum flight speed and the maximum rotation speed of the spherical object has passed since the generation time of the first trigger signal;

a photographing unit which photographs a plurality of images of the spherical object with respect to a first image acquisition region having a certain area in accordance with a first trigger signal and a second trigger signal;

an image acquisition unit which provides the first trigger signal and the second trigger signal, which are inputted from the trigger signal generation unit, to the photographing unit and converts and stores the plurality of the images inputted from the photographing unit into a digital image in response to the first trigger signal and the second trigger signal; and an information measuring unit which computes the flight parameter including a flight speed, a flight angle, a rotation speed and a rotation axis of a spherical object from the plurality of the digital images, wherein the reference time interval is determined with the maximum value of the reference time interval obtained by the formula A, wherein the formula A is, $$dT_{max}=\min(dT_{max1}, dT_{max2})$$

where $dT_{max}$ is the maximum value of the reference time interval, and $dT_{max1}$ is, $$dT_{max1} = \frac{(L_v - D_v)}{V_{max}}$$

where $L_v$ is the length of the vertical direction of the first image acquisition region, and $D_v$ is the distance that the spherical object flew in the vertical direction of the first image acquisition region until the spherical object is photographed in accordance with the first trigger signal since the coming-in boundary of the first image acquisition region, and $V_{max}$ is the value determined based on the maximum flight speed of the spherical object, and $dT_{max2}$ is, $$dT_{max2} = \frac{30}{N_{max}}$$

where $N_{max}$ is the maximum rotation speed of the golf ball.

2. A system for measuring flight parameters of a spherical object according to claim 1, wherein said trigger signal generation unit comprises:

an image sensor in which a plurality of photoelectric transformation elements are arranged in an array form, which elements serve to convert light inputted via a lens into electric signals;

a plurality of A/D converters which convert the electric signals from the photoelectric transformation elements into digital images;

an image memory for storing the digital images converted by the A/D converter;

a trigger circuit which generates and outputs the first trigger signal and the second trigger signal; and a microprocessor which sets a CCD line, as an active CCD line, which CCD line is to be processed for a signal conversion by the A/D converter among the CCD lines formed of the photoelectric transformation elements residing at the same row among the photoelectric transformation elements forming the image sensor, said active CCD line obtaining an image with respect to a band-shaped second image acquisition region included in the first image acquisition region; and commands the trigger circuit to generate a first trigger signal when the spherical object is detected in the digital image stored in the image memory, and commands the trigger circuit to generate a second trigger signal when the reference time interval has passed since the generation command time of the first trigger signal.

3. A system for measuring flight parameters of a spherical object according to claim 2, wherein said microprocessor detects the region, where has a value larger than the reference brightness value, as a spherical object when the size and the shape of the region having a value larger than the reference brightness value previously set in the digital image stored in the image memory are the same as the size and shape of the spherical object.

4. A system for measuring flight parameters of a spherical object according to claim 3, further comprising:

a communication module which receives, from an external information process apparatus, a setting information of a CCD lie to be set as an active CCD line among the CCD lines, a reference time interval, a reference brightness value and the size and shape of the spherical object, respectively.

5. A system for measuring flight parameters of a spherical object according to claim 2, wherein said microprocessor serves to set a plurality of CCD lines among the plurality of the CCD lines at regular intervals as an active CCD line corresponding to the second image acquisition region.

6. A system for measuring flight parameters of a spherical object according to claim 5, wherein said microprocessor determines the reference time interval with the value which is smaller than or same as the maximum value of the reference time interval obtained by the formula A when the difference between the timing that the spherical object is detected from the digital image photographed by the first CCD line among a plurality of CCD lines and the timing that the spherical object is detected from the digital image photographed by the second CCD line is smaller than a previously set reference time; and determines the reference time interval with the value which is larger than the maximum value of the reference time interval obtained by the formula A when the difference between the timing that the spherical object is detected and the timing that the spherical object is detected from the digital image photographed by the second CCD line.

7. A system for measuring flight parameters of a spherical object according to claim 1, wherein said photographing unit comprises:

two pairs of area cameras which are arranged opposite to each other about the trigger signal generation unit at a plurality of rows which are set in parallel in the horizontal direction of the first image acquisition region, and said trigger signal is provided, at the same time, to the area cameras arranged at the first row among a plurality of the rows, and said second trigger signal is provided, at the same time, to the area cameras arranged at the first among the plurality of the rows.

8. A system for measuring flight parameters of a spherical object according to claim 1, wherein said photographing unit comprises two area cameras which are arranged in opposite to each other about the trigger signal generation at a row which is in parallel with the horizontal direction of the first image acquisition region, and said first and second trigger signals are provided, at the same time, to the area cameras.

9. A system for measuring flight parameters of a spherical object according to claim 1, further comprising:

a lighting unit which emits continuous light of which brightness is uniformly maintained.

10. A system for measuring flight parameters of a spherical object according to claim 1, wherein said information measuring unit serves to compute a first position which is a spatial position of a spherical object when the first trigger signal is outputted from a plurality of digital images in accordance with a first trigger signal; to compute a second position which is a spatial position of a spherical object when the second trigger signal is inputted from a plurality of digital images in response to a second trigger signal; and to compute a flight speed and a flight angle of the spherical object based on the computed first position, second position and the reference time interval.

11. A system for measuring flight parameters of a spherical object according to claim 10, wherein said information measuring unit serves to compute a first conversion matrix which allows the shapes of the selected first marking points to match with the shapes of the reference pattern data in such a way to recognize first marking points which are spatial positions of the marking points printed on the surface of the spherical object from a plurality of digital images in response to a first trigger signal, to recognize second marking points which are spatial position of the marking points printed on the surface of the spherical object from a plurality of digital images in response to a second trigger signal, and to search for a reference data which is a reference pattern data having the same shape as the shape which might be formed by selecting the first marking points as many as the above selection number; serves to compute a second conversion matrix which allows the shapes of the selected second marking points to match with the shapes of the reference pattern data after the marking points having the same shapes as the reference data among the second marking points are selected as many as the above selection number; and serves to compute the rotation speed and the rotation axis of the spherical object based on the first conversion matrix and the second conversion matrix.

12. A system for measuring flight parameters of a spherical object according to claim 11, wherein on the surface of the spherical object are formed the marking points so that the shapes of the marking points selected as many as the selection number are all different from one another.

13. A system for measuring flight parameters of a spherical object according to claim 11, wherein said information measuring unit forms a plurality of pairs of marking point coordinates by selecting the marking points as many as the selection number among the marking points after the marking points are selected more than a previously set reference number among the first marking points; searches for the matching marking points from the reference data after the marking points which are excluded from the pairs of the marking point coordinates among the marking points selected by the reference number by means of the first conversion matrix computed with respect to each pair of marking point coordinates; determines the first conversion matrix as the final first conversion matrix in response to the first trigger signal so that the errors between the marking points of the reference data matching to each marking point selected by the reference number becomes minimized, forms a plurality of pairs of marking point coordinates by selecting the marking points by means of the selection number among the marking points after the marking points more than a previously set reference number among the second marking points; searches for the matching marking points from the reference data after the marking pointes, which are excluded from the pairs of the marking coordinates among the marking points selected by the reference number by the second conversion matrix computed with respect to each pair of the marking point coordinates, are converted; and determines, as the final second conversion matrix in accordance with the second trigger signal, the second conversion matrix, which allows the errors between the marking points of the reference data matching with the marking points selected by the reference number to be minimized.

14. A method for measuring flight parameters of a spherical object, comprising:

a step (a) for generating and outputting a first trigger signal when a spherical object is detected;

a step (b) for photographing, multiple times, a first image of the spherical object in accordance with a first trigger signal with respect to a first image acquisition region having a certain area;

a step (c) for generating ad outputting a second trigger signal when a reference time interval set based on the maximum flight speed and the maximum rotation speed of the spherical object is passed since the generation timing of the first trigger signal;

a step (d) for photographing, multiple times, a second image of the spherical object with respect to the first image acquisition region in accordance with a second trigger signal; and a step (e) for computing the flight parameter including a flight speed, a light angle, a rotation angle and a rotation axis of the spherical object from the first and second images, wherein said reference time interval is determined with the maximum value of the reference time interval obtained by the formula A, wherein the formula A is, $$dT_{max}=\min(dT_{max1}, dT_{max2})$$

Where $dT_{max}$ is the maximum value of the reference time interval, and $dT_{max1}$ is, $$dT_{max1} = \frac{(L_v - D_v)}{V_{max}}$$

(where $L_v$ is the length of the vertical direction of the first image acquisition region, and $D_v$ is the distance that the spherical object flew in the vertical direction of the first image acquisition region until the spherical object is photographed in accordance with the first trigger signal since the coming-in boundary of the first image acquisition region, and $V_{max}$ is the value determined based on the maximum flight speed of the spherical object, and $dT_{max2}$ is, $$dT_{max2} = \frac{30}{N_{max}}$$

where $N_{max}$ is the maximum rotation speed of the golf ball.

15. A method for measuring flight parameters of a spherical object according to claim 14, further comprising:

a step (f) for setting a CCD line, which is to be converted into a digital signal, among the CCD lines formed of photoelectric transformation elements residing in the same row in the photoelectric transformation elements forming an image sensor, as an active CCD line matching with a band-shaped second image acquisition region included in the first image acquisition region.

16. A method for measuring flight parameters of a spherical object according to claim 15, wherein in said steps (a) an (c), when the size and the shape of the region which are larger than a previously set reference brightness value in each mage photographed with respect to the second image acquisition region are the same as the size and shape of the spherical object, the region larger than the reference brightness value is detected as the spherical object.

17. A method for measuring flight parameters of a spherical object according to claim 16, further comprising:

a step (g) for receiving a setting information of a CCD line to be set as an active CCD line among the CCD lines, a reference time interval, a reference brightness value and the size and shape of the spherical object from an external information process apparatus.

18. A method for measuring flight parameters of a spherical object according to claim 15, wherein in said step (f), a plurality of CCD lines arranged at regular intervals among the CCD lines are set as active CCD lines.

19. A method for measuring flight parameters of a spherical object according to claim 18, wherein in said step (f), when a difference between a timing that the spherical object is detected from the digital image photographed by a first CCD line among a plurality of CCD lines and a timing that a spherical object is detected from a digital image photographed by a second CCD line is less than a previously set reference time, the reference time interval is determined with a time which is smaller than or same as the maximum value of the reference time interval obtained by the following formula A; and when a difference between a timing when the spherical object is detected and a timing that the spherical object is detected from a digital image photographed by a second CCD line is larger than a previously set reference time, a reference time interval is determined with a value larger than or same as the maximum value of the reference time interval obtained by the formula A.

20. A method for measuring flight parameters of a spherical object according to claim 14, wherein in said step (b), said first images are photographed by a pair of area cameras arranged in a first row among a plurality of rows set in parallel with a horizontal direction of the first image acquisition region to which the first trigger signals are transmitted at the same time, and in said step (d), said second images are photographed by a pair of area cameras arranged in a second row among a plurality of rows set in parallel with a horizontal direction of the first image acquisition region to which the first trigger signals are transmitted at the same time.

21. A method for measuring flight parameters of a spherical object according to claim 14, wherein said step (e2) comprises: a step (e1)) for computing, in accordance with a first trigger signal, a first position which is a spatial position of a spherical object when a first trigger signal is outputted from a plurality of digital images, and computing, in accordance with a second trigger signal, a second position which is a spatial space of a spherical object when a second trigger signal is outputted from a plurality of digital images; and a step (e2) for computing a flight speed and a flight angle of a spherical object based on the computed first position and second position and the reference time interval.

22. A method for measuring flight parameters of a spherical object according to claim 21, wherein said step (e) comprises:

a step (e3) for recognizing a first marking point which is the spatial positions of the marking points printed on a surface of a spherical object from a plurality of digital images in accordance with a first trigger signal, and for recognizing a second marking point which is the spatial positions of the marking points printed on a surface of the spherical object from a plurality of digital images in accordance with a second trigger signal;

a step (e4) for computing a first conversion matrix so the shapes of the selected first marking points becomes the same as the shapes of the reference pattern data after searching for the reference data which is a reference pattern data having the same shape as the shape which might be formed by selecting the first marking points as many as the selection number from the reference pattern data formed of the shapes formed by selecting the marking points printed on a surface of the spherical object as many as a previously set selection number; a step (e5) for computing a second conversion matrix so that the shapes of the selected second marking points become the same as the shapes of the reference pattern data after selecting the marking points as many as the selection number, which marking points can form the same shape as the reference data among the second marking points; and a step (e6) for computing the rotation speed and the rotation axis of the spherical object based on the first conversion matrix and the second conversion matrix.

23. A method for measuring flight parameters of a spherical object according to claim 22, wherein on a surface of the spherical object are printed the marking points so that the shapes formed by the marking points selected as many as the selection number become different from one another.

24. A method for measuring flight parameters of a spherical object according to claim 22, wherein said step (e4) comprises:

a step (e4-1) for selecting the marking points more than a previously set number among the first marking points and for forming a plurality of pairs of marking points by selecting the marking points as many as the selection number among the selected marking points;

a step(e4-2) for searching for the matching marking points from the reference data after converting the marking points excluded from the pairs of the coordinates of the marking points among the selected marking points as many as the reference number based on the first conversion matrix computed with respect to each pair of coordinates of the marking points; and a step (e4-3) for determining a first conversion matrix as the final first conversion matrix in accordance with a first trigger signal, which first conversion matrix allows the errors between the marking points of the reference data matching with the selected marking points as many as the reference number, to be minimized, and said step (e5) comprises:

a step (e5-1) for selecting the marking points more than a previously set number among the second marking points and for forming a plurality of pairs of marking points by selecting the marking points as many as the selection number among the selected marking points;

a step(e5-2) for searching for the matching marking points from the reference data after converting the marking points excluded from the pairs of the coordinates of the marking points among the selected marking points as many as the reference number based on the second conversion matrix computed with respect to each pair of coordinates of the marking points; and a step (e5-3) for determining a second conversion matrix as the final second conversion matrix in accordance with a second trigger signal, which second conversion matrix allows the errors between the marking points of the reference data matching with the selected marking points as many as the reference number, to be minimized.

25. A non-transitory recording medium which can be readable by a computer with a program installed to execute a method for measuring the flight parameters of a spherical object on a computer based on claim 14.

* * * * *